US009804548B2

(12) United States Patent
Kato et al.

(10) Patent No.: US 9,804,548 B2
(45) Date of Patent: Oct. 31, 2017

(54) MEDIUM CARRYING DEVICE AND IMAGE FORMING APPARATUS

(71) Applicant: Oki Data Corporation, Tokyo (JP)

(72) Inventors: Koji Kato, Tokyo (JP); Kyosuke Nakazato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/131,325

(22) Filed: Apr. 18, 2016

(65) Prior Publication Data

US 2016/0349685 A1 Dec. 1, 2016

(30) Foreign Application Priority Data

May 28, 2015 (JP) ..... 2015-108725

(51) Int. Cl.
*G03G 15/00* (2006.01)
*B65H 37/00* (2006.01)
(Continued)

(52) U.S. Cl.
CPC ..... *G03G 15/50* (2013.01); *B41J 3/4075* (2013.01); *B41J 11/0095* (2013.01);
(Continued)

(58) Field of Classification Search
CPC .... B41J 11/0095; B41J 11/009; B41J 3/4075; G03G 15/50; B65H 37/002;
(Continued)

(56) References Cited

U.S. PATENT DOCUMENTS 5,828,924 A * 10/1998 Fukada ..... G03G 15/1655 250/200
2002/0033853 A1* 3/2002 Aratsu ..... B41J 11/0075 347/16

(Continued)

FOREIGN PATENT DOCUMENTS

JP 2002137478 A * 5/2002
JP 2014-106413 A 6/2014

*Primary Examiner* — David Banh
(74) *Attorney, Agent, or Firm* — Muncy, Geisseler, Olds & Lowe, P.C.

(57) ABSTRACT

A medium carrying device includes a carrying part that carries a continuous print medium, a detection part that includes a light emitting part and a light receiving part arranged sandwiching a carrying path, and that detects the print medium carried on the carrying path according to a light amount that is received by the light receiving part, and a control part that controls operations of the carrying part and the detection part, wherein the control part sets a first emitted light amount of the emitted light of the light emitting part used in image formation to the print medium by performing a light amount measurement using the light emitting part and the light receiving part in a state where the print medium is carried to a first position, and sets a threshold light amount that is used in detecting a boundary position between the first region and the second region by the detection part through performing another light amount measurement by obtaining a receiving light amount of the light receiving part with the first emitted light amount and by determining the threshold light amount based on the receiving light amount in a state where the print medium is carried from the first position to another second position.

11 Claims, 22 Drawing Sheets

(51) Int. Cl.

| | |
|---|---|
| ***B41J 3/407*** | (2006.01) |
| ***B41J 11/00*** | (2006.01) |
| ***B65H 39/14*** | (2006.01) |
| ***B65H 20/02*** | (2006.01) |
| ***B65H 35/06*** | (2006.01) |
| *B26F 1/38* | (2006.01) |

(52) U.S. Cl.
CPC ..... *B65H 20/02* (2013.01); *B65H 35/06* (2013.01); *B65H 37/002* (2013.01); *B65H 39/14* (2013.01); *B26F 1/384* (2013.01); *B65H 2404/143* (2013.01); *B65H 2511/23* (2013.01); *B65H 2513/11* (2013.01); *B65H 2553/412* (2013.01); *B65H 2555/134* (2013.01); *B65H 2557/512* (2013.01); *B65H 2701/1311* (2013.01); *B65H 2701/1313* (2013.01); *B65H 2701/194* (2013.01); *B65H 2801/12* (2013.01)

(58) Field of Classification Search
CPC .. B65H 2701/194; B65H 39/14; B65H 20/02; B65H 35/06; B65H 2404/143; B65H 2511/23; B65H 2513/11; B65H 2553/412; B65H 2555/134; B65H 2557/512; B65H 2701/1311; B65H 2701/1313; B65H 2801/12; B26F 1/384
See application file for complete search history.

(56) References Cited

U.S. PATENT DOCUMENTS

| | | | | |
|---|---|---|---|---|
| 2005/0212833 | A1* | 9/2005 | Yoshida | H04N 1/6033 347/5 |
| 2006/0017762 | A1* | 1/2006 | Hwang | B41J 11/009 347/16 |
| 2006/0083129 | A1* | 4/2006 | Yun | B41J 11/009 369/47.1 |
| 2009/0060532 | A1* | 3/2009 | Morimoto | G03G 15/607 399/21 |
| 2013/0094889 | A1* | 4/2013 | Cheng | B41J 13/0009 400/76 |
| 2013/0096870 | A1* | 4/2013 | Cheng | B41J 11/0095 702/150 |

* cited by examiner 1
10
9
9
2
3
Carrying Rollers
Medium Detection Sensors
Medium Detection Sensors
Lcut
Exposure Heads
(Image Forming Units)
Image Drum Units
31K
31C
31Y
31M
31W
30K
30C
30Y
30M
30W
32K
32C
32Y
32M
32W
33
34a
34b
35
22a
22b
22c
22d
22e
23
211
212
213
214
41
4
51
52a
52b
Ejection Rollers
d1
d2

(T100~T101)

(T101~T106)

(T108~T109)

(T106~T108)

(T106~T109)

(T109～T115)

(T200~T201)

(T201～T207)

(T207～T213)

MEDIUM CARRYING DEVICE AND IMAGE FORMING APPARATUS

CROSS REFERENCE TO RELATED APPLICATIONS

This application claims priority under 35 USC 119 to Japanese Patent Application No. 2015-108725 filed on May 28, 2015, the entire contents which are incorporated herein by reference.

TECHNICAL FIELD

This invention relates to a medium carrying device that carries a print medium, and an image forming apparatus provided with such a medium carrying device.

BACKGROUND

In an image forming apparatus, for example, image formation is performed to a print medium such as a sheet of paper, and afterwards fusion and sheet ejection are performed (for example, see Patent Document 1).

RELATED ART

[Patent Document 1]
Unexamined Japanese Patent Application 2014-106413

By the way, in an image forming apparatus in general, when carrying a print medium, it is desired to detect the print medium with high accuracy.

This invention was made considering such a problem, and its objective is to provide a medium carrying device and an image forming apparatus that can detect a print medium with high accuracy.

SUMMARY

A medium carrying device disclosed in the application includes a carrying part that carries a print medium comprising a first medium and multiple second media disposed with a specified interval each other on the first medium along a carrying path, the first medium being a continuous sheet, a detection part that includes a light emitting part and a light receiving part arranged sandwiching the carrying path, and that detects the print medium carried on the carrying path according to a light amount of a light that is received by the light receiving part, the light being emitted from the light emitting part and coming through the carrying path, and a control part that controls operations of the carrying part and the detection part. The print medium comprises a first region positioned between the multiple second media and a second region that is a region where the second media are disposed on the first medium, the detection part performs light amount measurements, the light amount measurements being processes using the light emitting part and the light receiving part in which a light emitting amount by the light emitting part is determined so that the light receiving part receives a predetermined light receiving amount from the light emitting part, and the control part sets a first emitted light amount (VDA1) of the emitted light of the light emitting part used in image formation to the print medium by performing the light amount measurement in a state where the print medium is carried to a first position that is a position where the first region of the print medium is facing with the detection part, and sets a threshold light amount (Vlabel) that is used in detecting a boundary position between the first region and the second region by the detection part through performing another light amount measurement by obtaining a receiving light amount of the light receiving part with the first emitted light amount and by determining the threshold light amount based on the receiving light amount in a state where the print medium is carried from the first position to a second position that is a position where the second region is facing with the detection part.

An image forming apparatus disclosed in the application includes the medium carrying device discussed above and an image forming part that performs image formation to the print medium carried up by the medium carrying device.

According to the medium carrying device and the image forming apparatus of this invention, it becomes possible to detect a print medium with high accuracy.

DETAILED DESCRIPTION OF EMBODIMENTS

Below, embodiments of this invention are explained in detail referring to drawings. Note that the explanations are given in the following order.

1. First embodiment (An example of performing setting in the base sheet region after setting in the first label region)
2. Second embodiment (An example of directly performing setting in the base sheet region after detecting the leading edge of the label sheet)
3. Modifications

1. First Embodiment

[Outline Configuration]

Figure 1:
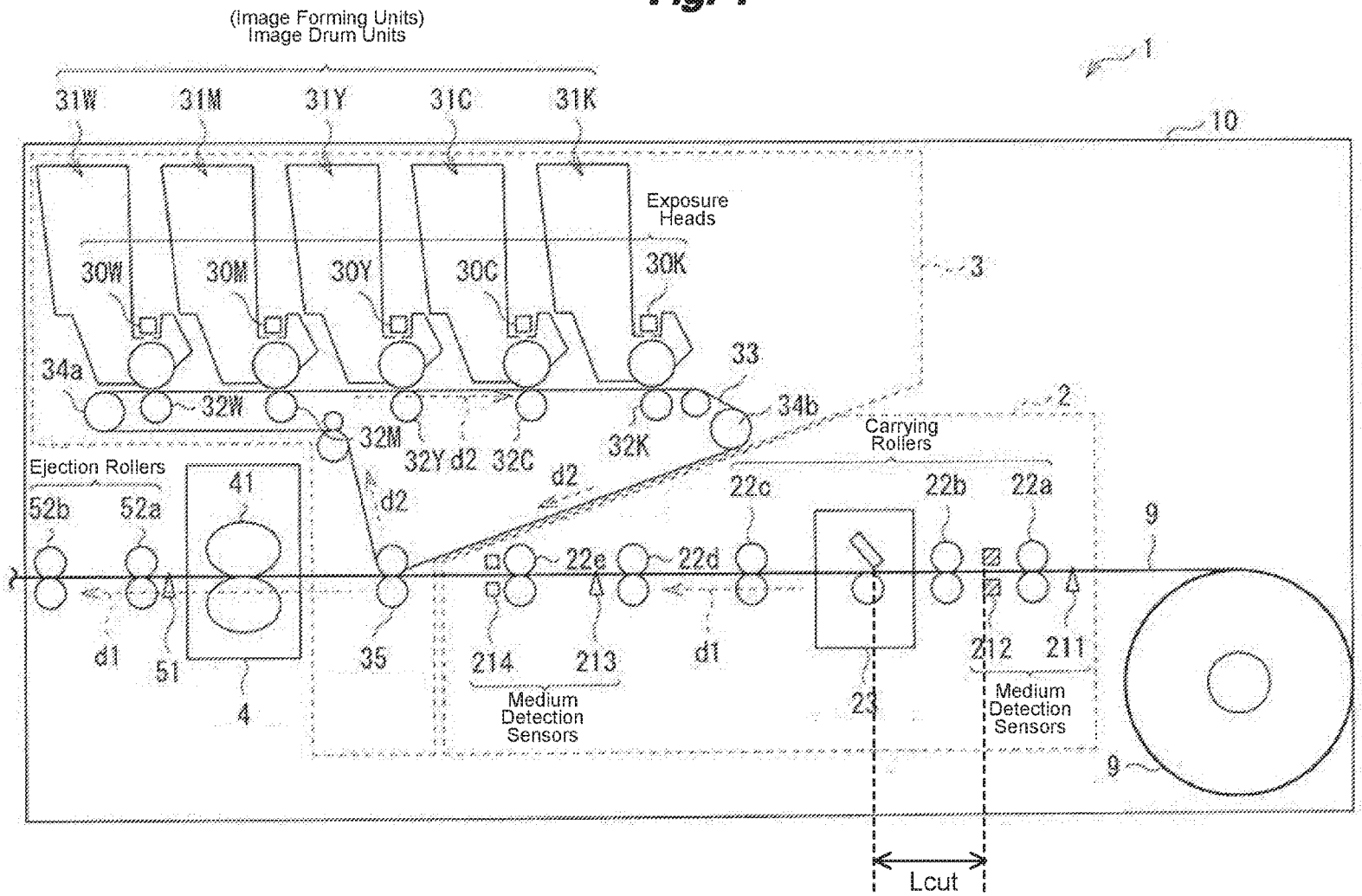
FIG. 1 is a schematic diagram showing an outline configuration example of an image forming apparatus of the first embodiment of this invention.

FIG. 1 schematically shows an outline configuration example of an image forming apparatus (image forming apparatus 1) of the first embodiment of this invention. The image forming apparatus 1 functions as a printer (a color printer in this example) that forms an image (a color image in this example) using an electrophotographic system to a label sheet 9 as a print medium. That is, this image forming apparatus 1 functions as a so-called label printer. Also, as explained below, the image forming apparatus 1 is a so-called intermediate transfer type image forming apparatus that transfers toner images to the label sheet 9 via an intermediate transfer belt 33 mentioned below. Note that this image forming apparatus 1 corresponds to a specific example of the "image forming apparatus" in this invention.

(Label Sheet 9)

Figures 2A, 2B:
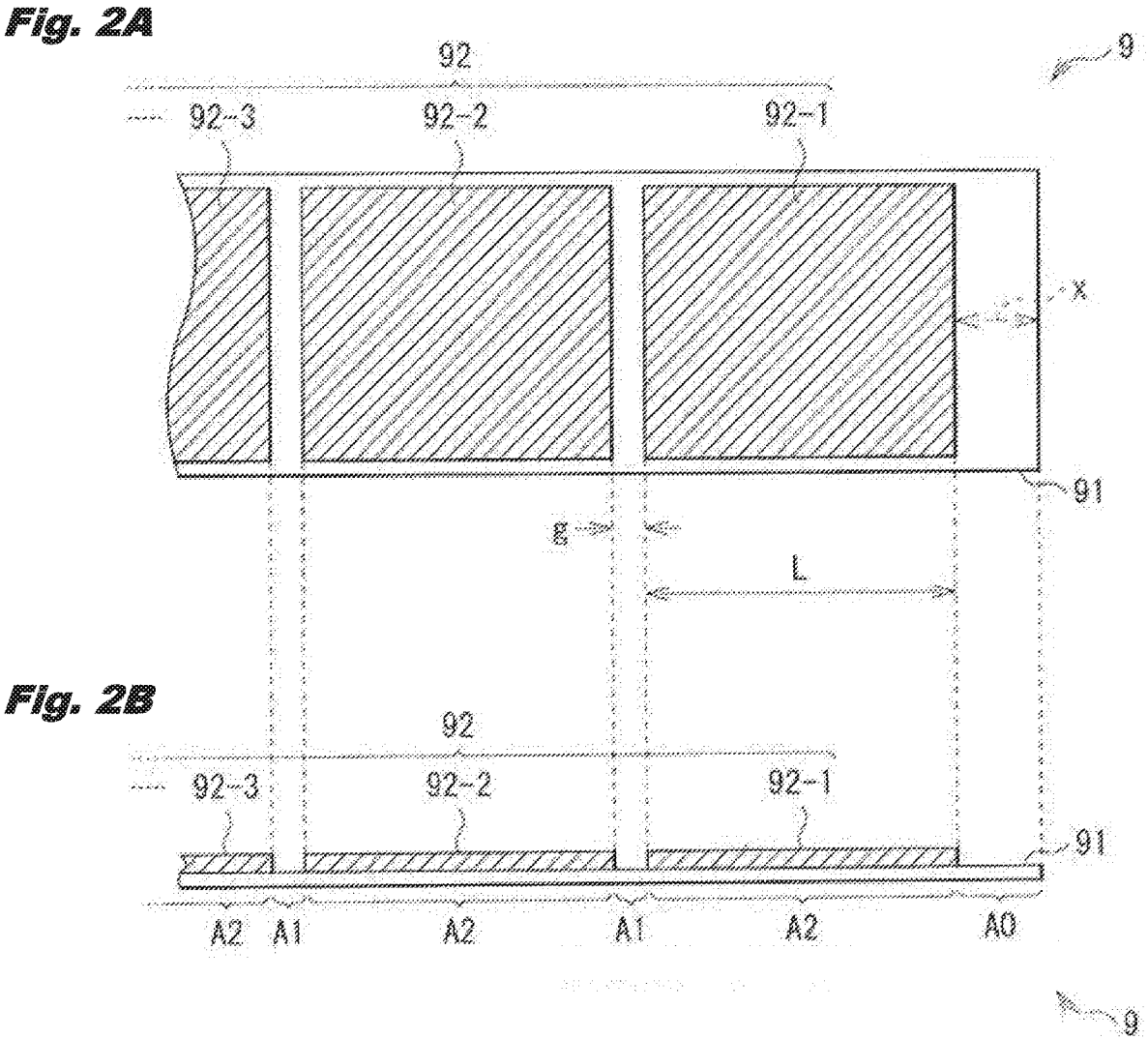
FIGS. 2A and 2B are schematic diagrams showing a configuration example of a label sheet shown in FIG. 1.

First of all, explained here is a configuration example of the label sheet 9 applied to this image forming apparatus 1. FIG. 2 schematically shows a configuration example of the label sheet 9, where FIGS. 2A and 2B show the upper face configuration example and the side face (long side face of the label sheet 9) configuration example, respectively.

This label sheet 9 comprises a base sheet 91 that extends along a specified direction (carrying direction d1 mentioned below) and multiple labels 92 disposed (pasted) on this base sheet 91 with specified intervals (of gap length g mentioned below). These multiple labels 92 are disposed in a queue along the extending direction (long side direction) of the label sheet 9 (base sheet 91) and hereafter called labels 92-1, 92-2, 93-3, and so on, sequentially from the leading edge side of the base sheet 91. Also, this label sheet 9 is provided with a leading edge region A0 that is a region in the vicinity of its leading edge (a region with only the base sheet 91), a base sheet region (gap region) A1 that is located between multiple labels 92 (region with only the base sheet 91), and a label region A2 where one of the labels 92 is disposed on the base sheet 91 (region where the base sheet 91 and one of the labels 92 are superimposed). Below, length of the leading edge region A0 (length in the long side direction) is called as leading edge length x, length of the base sheet region A1 as gap length g, and length of the label region A2 as label length L. Note that these leading edge length x, gap length g, and label length L are assumed to have values input by a user of the image forming apparatus 1 (utilizing a setting operation to an operation panel 602). However, the leading edge length x may not necessarily have an input value.

Here, the label sheet 9 corresponds to a specific example of the "print medium" in this invention, the base sheet 91 corresponds to a specific example of the "first medium" in this invention, and the labels 92 correspond to a specific example of the "second media" in this invention. Also, the label 92-1 corresponds to a specific example of the "first of the second media from the leading edge position" in this invention, and the label 92-2 corresponds to a specific example of the "second of the second media from the leading edge position" in this invention. The leading edge length x corresponds to a specific example of the "length from the leading edge position of the print medium to the first of the second media" in this invention, the gap length g corresponds to a specific example of the "length of the first region along the carrying direction" in this invention, and the label length L corresponds to a specific example of the "length of the second region along the carrying direction" in this invention.

As shown in FIG. 1, the image forming apparatus 1 is provided with a medium carrying device 2 that carries the label sheet 9, an image forming part 3, a fuser 4 (fuser device), an ejection sensor 51, and ejection rollers 52*a* and 52*b*. Here, the medium carrying device 2 corresponds to a specific example of the "medium carrying device" in this invention, and the image forming part 3 corresponds to a specific example of the "image forming part" in this invention. Note that, as shown in FIG. 1, these members are accommodated inside a specified chassis 10 comprising an openable cover, etc. (not shown).

(Medium Carrying Device 2)

The medium carrying device 2 is a device that carries the label sheet 9 wound in a roll shape as shown in FIG. 1 along a carrying path (carrying direction d1 shown in FIG. 1) from its leading edge side. This medium carrying device 2 comprises, as shown in FIG. 1, five carrying rollers 22*a*, 22*b*, 22*c*, 22*d*, and 22*e*, four medium detection sensors 211, 212, 213, and 214, and a cutter unit 23.

The carrying rollers 22*a*, 22*b*, 22*c*, 22*d*, and 22*e* are members that carry the label sheet 9 in the carrying direction d1 by utilizing the rotation of the rollers to the side of a secondary transfer roller 35 mentioned below. These carrying rollers 22*a*-22*e* correspond to a specific example of the "carrying part" in this invention.

The medium detection sensors 211, 212, 213, and 214 are sensors that detect the label sheet 9 carried along the carrying direction d1. Specifically, these medium detection sensors 211-214 detect the presence of the label sheet 9, the leading and trailing edges of the label sheet 9, the boundary between the base sheet region A1 and the label region A2 within the label sheet 9, and the like. Among these, the medium detection sensors 211 and 213 are each in one unit with an unshown lever and perform such detections by utilizing the fact that a light blocking state and a light transmitting state are switched by the lever rotating by the carriage of the label sheet 9. That is, these medium detection sensors 211 and 213 are photointerrupters. On the other hand, each of the medium detection sensors 212 and 214 is configured including a light emitting part and a light receiving part and performs such detections according to the amount of light (received light amount) emitted from this light emitting part and received by the light receiving part through the carrying path. That is, these medium detection sensors 212 and 214 are so-called transmission sensors.

Figure 4:
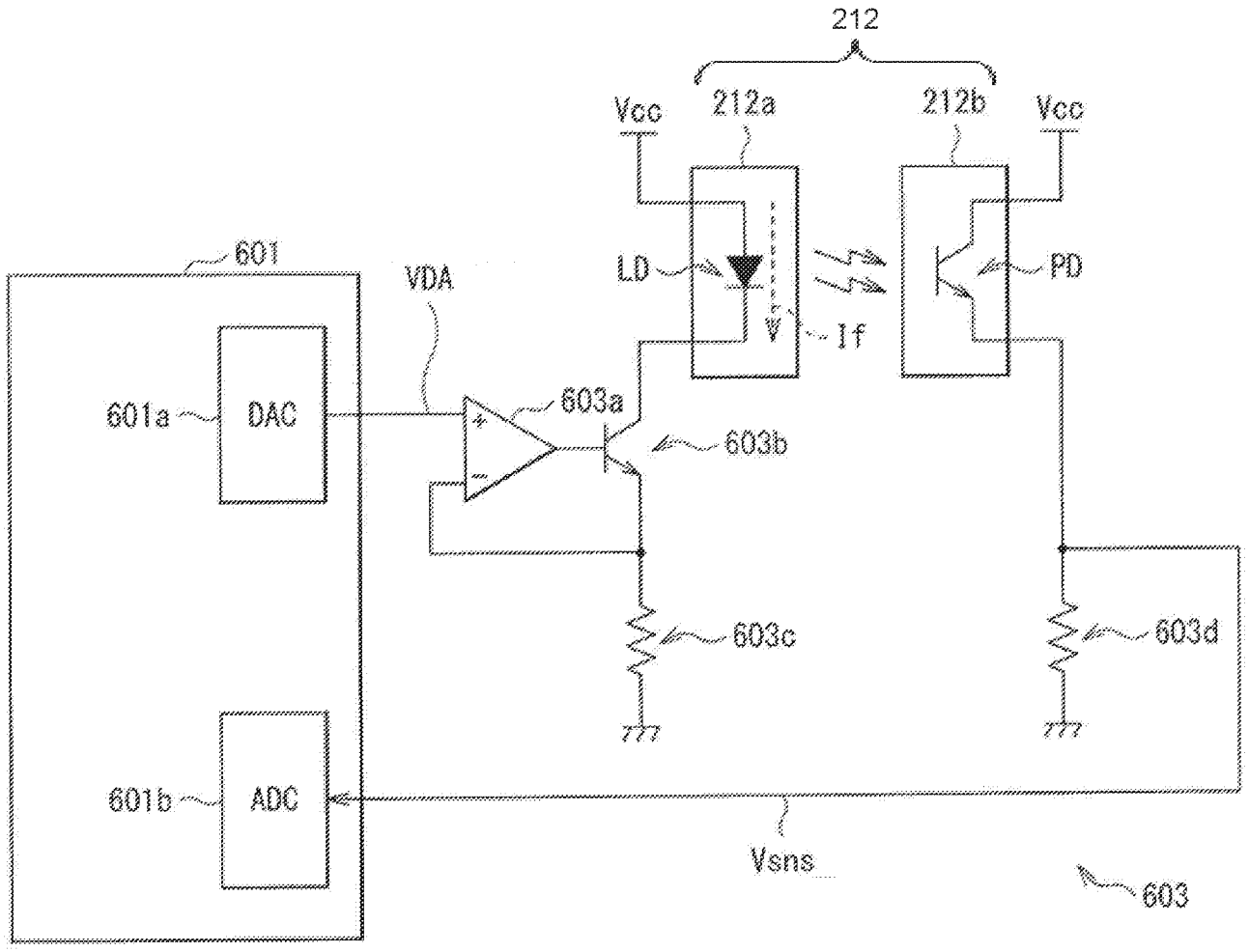
FIG. 4 is a circuit diagram showing a configuration example of a detection mechanism using a medium detection sensor shown in FIGS. 1 and 3.

Here, the medium detection sensor 212 corresponds to a specific example of the "detection part" in this invention, and its detailed configuration example is mentioned below (FIG. 4).

The cutter unit 23 is configured using a rotary cuter for example. The cutter unit 23 utilizes the rotation motion of this rotary cutter or the like to enable cutting the label sheet 9 carried along the carrying direction d1.

(Image Forming Part 3)

The image forming part 3 is a part that performs image formation (printing) to the label sheet 9 carried up by the medium carrying device 2. This image forming part 3 comprises, as shown in FIG. 1, five image drum units (image forming units) 31W, 31M, 31Y, 31C, and 31K, five exposure heads 30W, 30M, 30Y, 30C, and 30K, and the secondary transfer roller 35. The image forming part 3 also comprises five primary transfer rollers 32W, 32M, 32Y, 32C, and 32K, the intermediate transfer belt 33, and two drive rollers 34*a* and 34*b* that function as an intermediate transfer belt unit.

The image drum units 31W, 31M, 31Y, 31C, and 31K are disposed, as shown in FIG. 1, in a queue along the carrying direction (carrying path) d2 of the intermediate transfer belt 33 mentioned below. Specifically, the image drum units 31W, 31M, 31Y, 31C, and 31K are disposed in that order along this carrying direction d2 (from the upstream side toward the downstream side).

These image drum units 31W, 31M, 31Y, 31C, and 31K form images (toner images) on the intermediate transfer belt 33 mentioned below, using toners (developers) of different colors from one another. Specifically, the image drum unit 31W forms a toner image of white color using a white (W) toner, the image drum unit 31M forms a toner image of magenta color using a magenta (M) toner, and the image drum unit 31Y forms a toner image of yellow color using a yellow (Y) toner. In the same manner, the image drum unit 31C forms a toner image of cyan color using a cyan (C) toner, and the image drum unit 31K forms a toner image of black color using a black (K) toner.

Note that as coloring agents used for these white toner, magenta toner, yellow toner, cyan toner, and black toner, for example, dyes and pigments can be used alone or as multiple kinds combined.

Here, the image drum units 31W, 31M, 31Y, 31C, and 31K have the same configuration except using toners of different colors from one another to form toner images (developer images) as mentioned above. Specifically, each of these image drum units 31W, 31M, 31Y, 31C, and 31K comprises, as a mechanism for forming such a toner image, a toner cartridge (developer container), a photosensitive drum (image carrier), a charging roller (charging member), a development roller (developer carrier), a supply roller (developer supply member), and a cleaning member.

The toner cartridge is a container where each of the above-mentioned color toners is stored (accommodated) inside. The photosensitive drum is a member that carries an electrostatic latent image on its surface (surface layer part) and is configured using a photosensitive body (for example, an organic photosensitive body). The charging roller is a member that charges the surface of the photosensitive drum and is disposed so as to contact with the surface (circumferential face) of the photosensitive drum. The development roller is a member that carries a toner that develops the electrostatic latent image on its surface and is disposed so as to contact with the surface of the photosensitive drum. The supply roller is a member for supplying the toner to the development roller and is disposed so as to contact with the surface of the development roller. The cleaning member is a member for removing the toner (remaining toner) remaining on the surface of the photosensitive drum after a toner image is transferred onto a medium (intermediate transfer belt 33 mentioned below) by scraping it off this surface (cleaning).

The exposure heads 30W, 30M, 30Y, 30C, and 30K shown in FIG. 1 are devices that perform exposures by irradiating the surfaces of the above-mentioned photosensitive drums with irradiation light to form an electrostatic latent image on each of the surfaces (surface layer part) of these photosensitive drums. Each of such exposure heads 30W, 30M, 30Y, 30C, and 30K is configured including, for example, multiple light sources that emit irradiation light, and a lens array that focuses this irradiation light onto the surface of the photosensitive drum. Note that as these light sources, for example, light emitting diodes (LEDs), laser elements, and the like can be listed.

The intermediate transfer belt unit mentioned above is, as shown in FIG. 1, a belt unit, to which individual color toner images formed by the image drum units 31W, 31M, 31Y, 31C, and 31K are primary-transferred (intermediate-transferred). Also, the individual color toner images primary-transferred in this manner are, as mentioned below, secondary-transferred from this intermediate transfer belt unit to the label sheet 9 carried along the carrying direction d1.

As mentioned above, this intermediate transfer belt unit comprises five primary transfer rollers 32W, 32M, 32Y, 32C, and 32K, the intermediate transfer belt 33, and two drive rollers 34*a* and 34*b*.

The primary transfer rollers 32W, 32M, 32Y, 32C, and 32K are members for electrostatically transferring (primary-transferring) the individual color toner images formed inside the image drum units 31W, 31M, 31Y, 31C, and 31K onto the intermediate transfer belt 33, respectively. These primary transfer rollers 32W, 32M, 32Y, 32C, and 32K are, as shown in FIG. 1, disposed opposing the image drum units 31W, 31M, 31Y, 31C, and 31K through the intermediate transfer belt 33.

The intermediate transfer belt 33 is, as mentioned above, a belt to the surface of which the individual color toner images formed by the image drum units 31W, 31M, 31Y, 31C, and 31K are primary-transferred. In other words, such individual color toner images are temporarily carried on the surface of the intermediate transfer belt 33. This intermediate transfer belt 33 is, as shown in FIG. 1, suspended by multiple rollers including the drive rollers 34*a* and 34*b*. Also, the intermediate transfer belt 33 is driven by the drive rollers 34*a* and 34*b* to move rotationally along the carrying direction d2 shown in FIG. 1. The individual color toner images primary-transferred to the surface of the intermediate transfer belt 33 in this manner are secondary-transferred onto the label sheet 9 as mentioned below.

The secondary transfer roller 35 shown in FIG. 1 is a member for electrostatically transferring (secondary-transferring) onto the label sheet 9 the individual color toner images primary-transferred onto the intermediate transfer belt 33.

(Fuser 4 etc.)

The fuser 4 shown in FIG. 1 is a device for fusing by applying heat and a pressure to the toners (toner images) on the label sheet 9 carried up along the carrying direction d1 after the above-mentioned secondary transfer was performed. This fuser 4 is configured including, as shown in FIG. 1, a fuser roller 41.

The ejection sensor 51 is a sensor that detects the label sheet 9 in the downstream side of the fuser 4. Specifically, this ejection sensor 51 is also a photointerrupter mentioned above that detects the presence of the label sheet 9, the leading and trailing edges of the label sheet 9, etc.

The ejection rollers 52*a* and 52*b* are members for ejecting the label sheet 9 carried up along the carrying direction d1 toward the outside of the image forming apparatus 1.

[Configurations of the Control Mechanism etc.]

Figure 3:
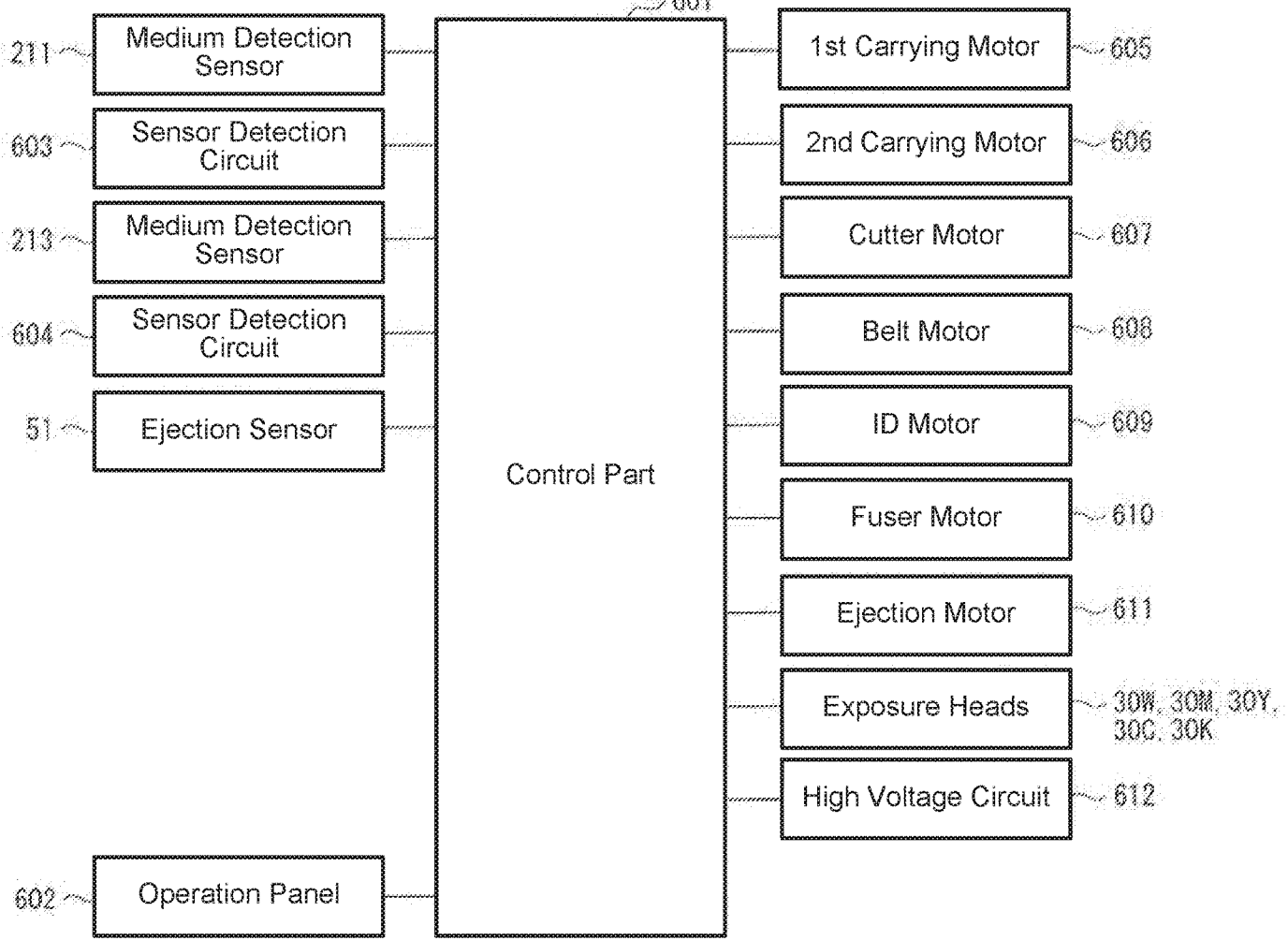
FIG. 3 is a block diagram showing a configuration example of a control mechanism in the image forming apparatus shown in FIG. 1.
Figure 5:
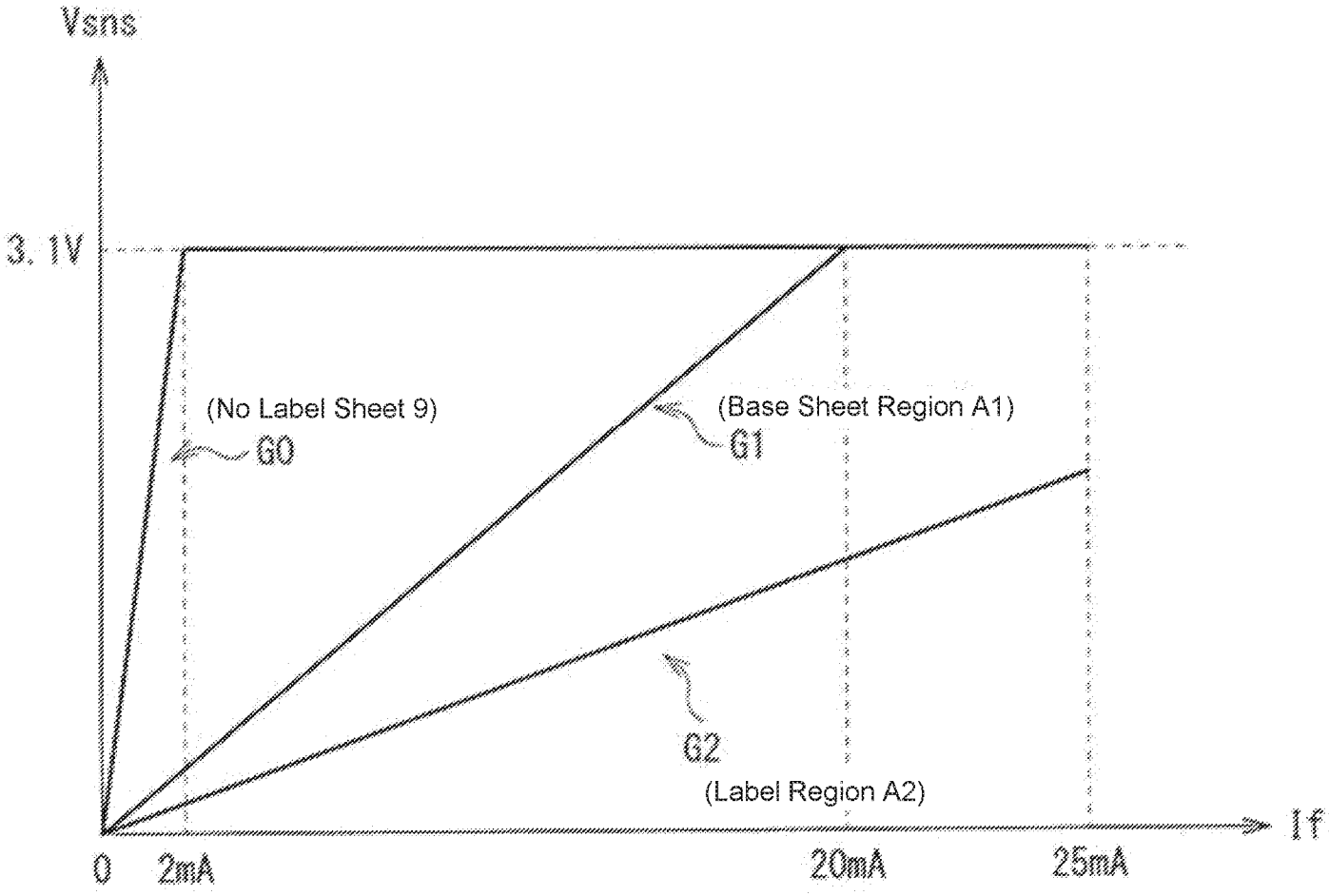
FIG. 5 is a schematic diagram showing an example of the corresponding relationship between a current flowing in a light emitting part and a sensor detection voltage shown in FIG. 4.

Next, referring to FIGS. 3-5 in addition to FIG. 1, the control mechanism etc. of the image forming apparatus 1 are explained. FIG. 3 shows, in a block diagram, a configuration example of such control mechanism of the image forming apparatus 1 along with its control objects etc.

As shown in FIG. 3, in this example, the following items are provided as the control mechanism of the image forming apparatus 1. That is, a control part 601, an operation panel 602, sensor detection circuits 603 and 604, a first carrying motor 605, a second carrying motor 606, a cutter motor 607, a belt motor 608, an ID motor 609, a fuser motor 610, an ejection motor 611, and a high voltage circuit 612 are provided.

The control part 601 controls the operations of members in the image forming apparatus 1, including the carrying rollers 22*a*, 22*b*, 22*c*, 22*d*, and 22*e*, the medium detection sensors 211, 212, 213, and 214, etc. Such control part 601 is configured including, for example, a microcomputer, etc. Note that the control part 601 corresponds to a specific example of the "control part" in this invention.

The operation panel 602 is a member that displays various kinds of information and accepts input by a user such as various kinds of setting values. Such operation panel 602 is configured, for example, using a touch panel of various kinds of systems.

The sensor detection circuits 603 and 604 are circuits for detecting the received light amount detected in the above-mentioned medium detection sensors 212 and 214 (transmission sensors), respectively, as voltage values (below-mentioned sensor output voltage Vsns). Note that a detailed configuration example in the sensor detection circuit 603 for the medium detection sensor 214 among these is mentioned below (FIG. 4).

The first carrying motor 605 is configured of a stepping motor for example. The rotation speed of the first carrying motor 605 is controlled by a pulse frequency supplied from the control part 601. Also, the first carrying motor 605 is connected with the carrying rollers 22*a* and 22*b* through a gear train, and by this first carrying motor 605 rotating, the carrying rollers 22*a* and 22*b* rotate.

The second carrying motor 606 is also configured of a stepping motor for example. The rotation speed of the second carrying motor 606 is also controlled by a pulse frequency supplied from the control part 601. Also, the second carrying motor 606 is connected with the carrying rollers 22*c*, 22*d*, and 22*e* through a gear train, and by this first carrying motor 606 rotating, the carrying rollers 22*c*, 22*d*, and 22*e* rotate.

The cutter motor 607 is also configured of a stepping motor for example. The rotation speed of the cutter motor 607 is also controlled by a pulse frequency supplied from the control part 601. Also, the cutter motor 607 is connected with the cutter unit 23 through a gear train, and by this cutter motor 607 rotating, the above-mentioned rotary cutter or the like inside the cutter unit 23 rotates.

The belt motor 608 is configured of a brushless DC (direct current) motor for example. This belt motor 608 is connected with the drive roller 34*a* etc. through a gear train and is a motor that rotationally drives the drive roller 34*a* and the like.

The ID motor 609 is also configured of a brushless DC motor for example. This ID motor 609 is connected with the image drum units 31W, 31M, 31Y, 31C, and 31K through a gear train and is a motor that rotationally drives the above-mentioned photosensitive drums etc. inside the image drum units 31W, 31M, 31Y, 31C, and 31K.

The fuser motor 610 is also configured of a brushless DC motor for example. This fuser motor 610 is connected with the fuser roller 41 inside the fuser 4 through a gear train and is a motor that rotationally drives the fuser roller 41.

The ejection motor 611 is configured of a stepping motor for example. This ejection motor 611 is connected with the ejection rollers 52*a* and 52*b* through a gear train and is a motor that rotationally drives the ejection rollers 52*a* and 52*b*.

The high voltage circuit 612 is a circuit that supplies high voltage to specified members inside the image forming apparatus 1.

Here, FIG. 4 shows, in a circuit diagram, a configuration example of the detection mechanism (above-mentioned sensor detection circuit 603 etc.) using the medium detection sensor 212.

As shown in FIG. 4, the sensor detection circuit 603 comprises an operational amplifier 603*a*, a transistor 603*b*, and resisters 603*c* and 603*d*. Also, the medium detection sensor 212 comprises a light emitting part 212*a* including a light emitting element LD, and a light receiving part 212*b* including a light receiving element PD. Also, provided inside the above-mentioned control part 601 are a DAC (Digital to Analog Converter) 601*a* and an ADC (Analog to Digital Converter) 601*b*.

The DAC 601*a* is a D/A converter having, for example, a 3.3-V full scale and an 8-bit resolution. This DAC 601*a* can output a DAC output voltage VDA of a specified analog voltage value in accordance with the control by the control part 601.

In the operational amplifier 603*a*, the DAC output voltage VDA supplied from the DAC 601*a* is input to its positive (+) side input terminal, its negative (−) side input terminal is connected to the emitter of the transistor 603*b* and one end of the resister 603*c*, and its output terminal is connected to the base of the transistor 603*b*. Also, the collector of the transistor 603*b* is connected to one end (cathode) of the below-mentioned light emitting element LD, and the other end of the resistor 603*c* is connected to the ground (grounded).

The light emitting part 212*a* is configured including a light emitting element LD that emits light such as infrared light for example, and this light emitting element LD is configured of light emitting diodes (LEDs) for example. Note that the other end (anode) of the light emitting element LD is connected to a power supply Vcc (for example, a 3.3-V power supply). On the other hand, the light receiving part 212*b* is configured including a light receiving element PD having sensitivity in the infrared region for example, and this light receiving element PD is configured of a phototransistor for example. Note that the collector of the light receiving element PD is connected to the power supply Vcc, the emitter of the light receiving element PD is connected to one end of the resistor 603*d* and the input terminal of an ADC 601*b* mentioned below. Here, such light emitting part 212*a* corresponds to a specific example of the "light emitting part" in this invention, and the light receiving part 212*b* corresponds to a specific example of the "light receiving part" in this invention.

The resistor 603*d* has, as mentioned above, one end connected to the emitter of the light receiving element PD and the input terminal of the ADC 601*b* and the other end connected to the ground.

The ADC 601*b* is an A/D converter having, for example, a 3.3-V full scale and a 10-bit resolution. This ADC 601*b* can convert the sensor output voltage Vsns that has an analog voltage value mentioned below into a digital voltage in accordance with the control by the control part 601.

In the detection mechanism shown in FIG. 4 having such a configuration, according to the magnitude of the DAC output voltage VDA (analog voltage) output from the DAC 601*a*, a forward current If that is a constant current flows to the light emitting element LD, and emission of the emitted light amount according to the magnitude of this forward current If is made by the light emitting element LD. Also, light that is emitted from this light emitting element LD and incident through the carrying path of the label sheet 9 is received by the light receiving element PD. Then, by an output current that is proportional to the received light amount on this light receiving element PD flowing to the resister 603*d*, this output current is input to the ADC 601*b* as the sensor output voltage Vsns. By utilizing such light emission operation and light receiving operation (light amount measurement mentioned below), although the details are mentioned below, the label sheet 9 carried in the carrying path is detected.

Note that, as shown in FIG. 5 for example, the correspondence relation of the above-mentioned forward current If and the sensor detection voltage Vsns is as follows. That is, in this example, as the forward current If increases, the sensor detection voltage Vsns linearly increases and becomes saturated when the sensor detection voltage Vsns=3.1 V (a voltage value that is lower than the power supply Vcc voltage=3.3 V as a reference by the saturation voltage of the light receiving element PD=0.2 V). Note that the received light amount on the light receiving element PD corresponding to such sensor output voltage Vsns corresponds to a specific example of the "received light amount" in this invention.

[Operation and Effect]

(A. Basic Operations of the Image Forming Apparatus 1 as the Whole)

In this image forming apparatus 1, an image is formed (a print operation is performed) to the label sheet 9 in the following manner. In other words, once print data (a print job) is supplied to the control part 601 via a communication circuit or the like from an external device such as a PC (Personal Computer), based on this print data, the control part 601 executes a print process so that members inside the image forming apparatus 1 perform the following operations.

That is, as shown in FIG. 1, first, the label sheet 9 stored in the chassis 10 is carried by the medium carrying device 2 from its leading edge side along the carrying direction d1 (carrying path). Then, on the label sheet 9 carried up in this manner, individual color toner images are formed by the image forming part 3.

Specifically, first, in the image drum units 31W, 31M, 31Y, 31C, and 31K inside the image forming part 3, individual color toner images are each formed through an electrophotographic process based on the above-mentioned print data. Then, the individual color toner images formed in this manner are sequentially primary-transferred onto the intermediate transfer belt 33 along the carrying direction d2. Then, the toner images (primary-transferred toner images) on this intermediate transfer belt 33 are secondary-transferred by the secondary transfer roller 35 to the label sheet 9 carried up.

Subsequently, the toners on the label sheet 9 carried up from this secondary transfer roller 35 side are fused onto this label sheet 9 with heat and a pressure applied by the fuser 4. Then, the label sheet 9 with a fusing operation made in this manner goes through the ejection sensor 51 and the ejection rollers 52*a* and 52*b* and is ejected to the outside of the image forming apparatus 1. Thereby, an image forming operation by the image forming apparatus 1 becomes complete.

(B. Detailed Operations of the Medium Carrying Device 2)

By the way, as a preliminary step for such an image forming operation, for example, sensitivity adjustments (calibrations) of the medium detection sensor 212 are performed. Specifically, as mentioned above for example, performed are sensitivity adjustments in the light emitting part 212*a*, the light receiving part 212*b*, and the like when detecting the presence of the label sheet 9, the leading and trailing edges of the label sheet 9, the boundary between the base sheet region A1 and the label region A2 within the label sheet 9, and the like. Then, using values set by such sensitivity adjustments, the subsequent image forming operation, which is mainly for confirming a sheet position so that an image position is set to a label, is performed.

(B-1. Comparative Example)

Here, in a conventional method of a comparative example, the sensitivity adjustments of such medium detection sensor 212 (adjustment of the amount of light of the light emitting part 212*a* and the like) are performed in the label region A2 position of the label sheet 9. This is because it is easier to make an adjustment of the amount of light and the like in the label region A2 having a relatively large area within the label sheet 9 than in the base sheet region A1 (gap region) having a relatively narrow area. Note that the magnitude relation of transmittances (light transmittances) and the above-mentioned sensor output voltage Vsns values in the regions within this label region 9 is: Transmittance in the label region A2 (sensor output voltage Vsns)<Transmittance in the base sheet region A1 (sensor output voltage Vsns).

However, in the method of this comparative example, if transmittance in the base sheet region A1 is low for example, because the difference of the sensor output voltage Vsns between the base sheet region A1 and the label region A2 becomes low, it becomes difficult to detect their boundary (boundary position). Therefore, detection of print media (label sheets) having a variety of transmittances cannot be supported, making it difficult to detect print media with high accuracy.

(B-2. Sensitivity Adjustments in this Embodiment)

Then, in the image forming apparatus 1 of this embodiment, the problem in the comparative example mentioned above is resolved by performing sensitivity adjustments of the method explained below.

Figure 6:
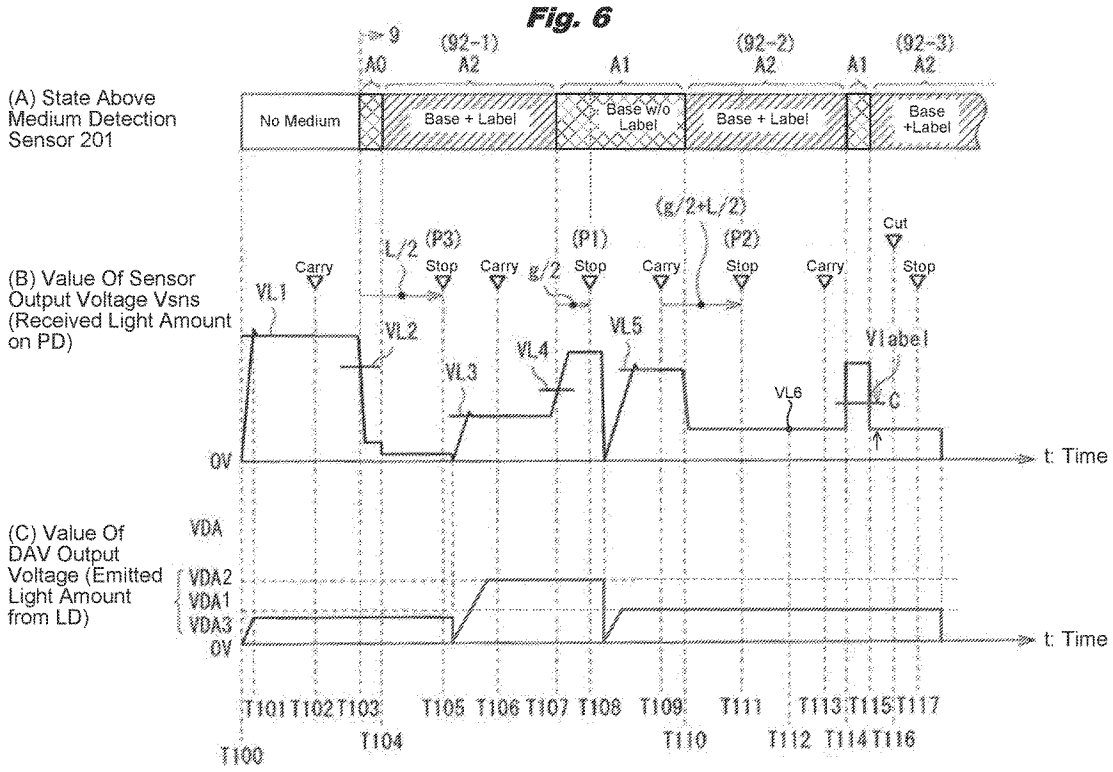
FIG. 6 is a timing chart showing an operation example of a medium carrying device of the first embodiment.

FIG. 6 shows in a timing chart an operation example (operation example during the sensitivity adjustments) of the medium carrying apparatus 2 of this embodiment. Specifically, (A) of FIG. 6 shows a state above the medium detection sensor 212 (what is disposed above facing with the medium detection sensor 212, or nothing is disposed facing with it) in this operation example. A0 and A1 indicate that there is the base sheet but no label is present (Base w/o Label). At the left from A0 indicates that there is no medium. (B) of FIG. 6 shows the value of the sensor output voltage Vsns mentioned above during this operation, which corresponds to the received light amount on the light receiving element PD. (C) of FIG. 6 shows the value of the DAC output voltage VDA mentioned above during this operation, which corresponds to the emitted light amount of the light emitting element LD.

Also, FIGS. 7, 9A, 9B, 11A, 11B, and 13 show the operation example during the sensitivity adjustment shown in FIG. 6 in flow charts in the order of time sequence. Then, FIGS. 8, 10, 12, and 14 schematically show in side views the example states of the medium carrying device 2 during the operations shown in these FIGS. 7, 9A, 9B, 11A, 11B, and 13.

Figure 7:
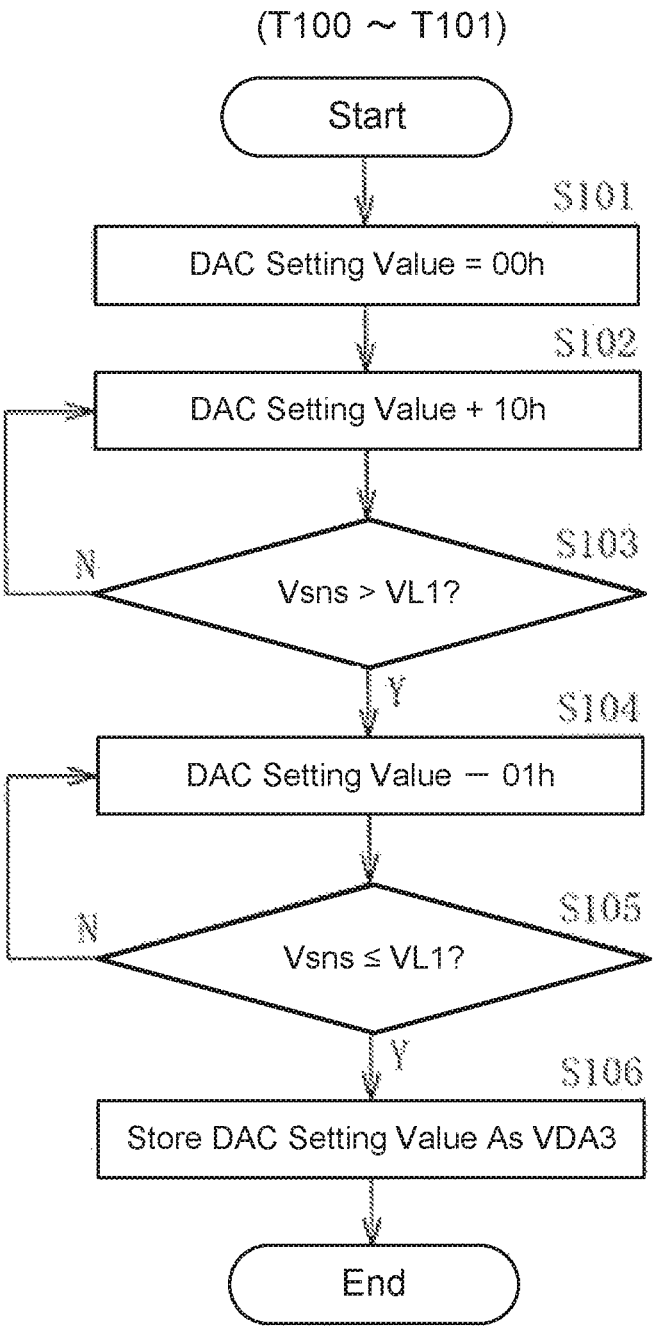
FIG. 7 is a flow chart showing an operation example during a partial period in the operation example shown in FIG. 6.
Figure 8:
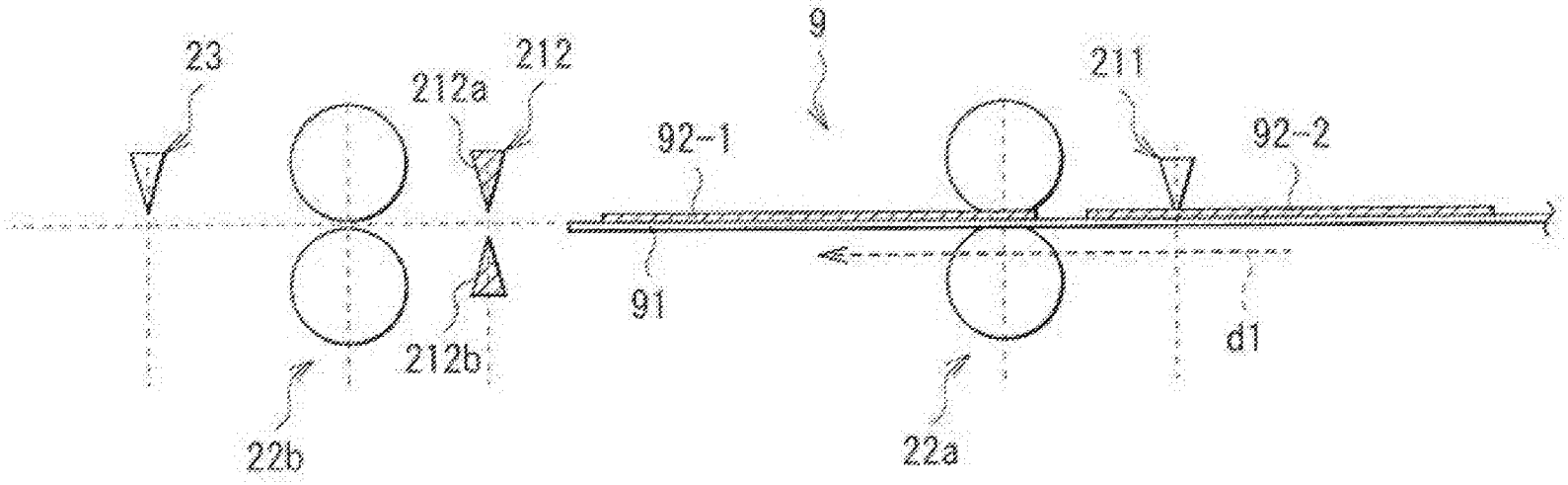
FIG. 8 is a schematic diagram showing an example state of the medium carrying device in the operation example shown in FIG. 7.

(Timings T100-T101: FIGS. 7 and 8)

In the sensitivity adjustments of this embodiment, first, during the period of timings T100-T101 in FIG. 6, the control part 601 performs controls in the manner shown in FIGS. 7 and 8 for example.

At this timing T100, as shown in FIGS. 6 and 8, the label sheet 9 is in a state not facing with the medium detection sensor 212. In such a state, the control part 601 first sets the DAC 601*a* setting value to 00h to put the light emitting element LD into an extinguished state (S101 in FIG. 7). Next, the control part 601 increases the DAC 601*a* setting value by +10h to put the light emitting element LD into an emitting state (increase the emitted light amount) (S102).

Subsequently, the control part 601 judges whether the sensor output voltage Vsns corresponding to the received light amount obtained by the light receiving element PD based on such light emission of the light emitting element LD has become higher than a specified threshold voltage VL1 (for example, VL1=2.5 V) (whether Vsns>VL1 is satisfied) (S103). Here, if it is judged that the sensor output voltage Vsns is not higher than the threshold voltage VL1 (Vsns>VL1 is not satisfied) (S103: N), the system transitions to S102 again to increase the emitted light amount.

On the other hand, if it is judged that the sensor output voltage Vsns is higher than the threshold voltage VL1 (Vsns>VL1 is satisfied) (S103: Y, Timing T101), the following occur. That is, next, the control part 601 decreases the DAC 601*a* setting value by 01h to decrease the emitted light amount (S104). Then, the control part 601 judges whether the sensor output voltage Vsns at that time has become no higher than the above-mentioned threshold voltage VL1 (whether Vsns≤VL1 is satisfied) (S105). Here, if it is judged that the sensor output voltage Vsns is higher than the threshold voltage VL1 (Vsns≤VL1 is not satisfied) (S105: N), the system transitions to S104 again to decrease the emitted light amount.

On the other hand, if it is judged that the sensor output voltage Vsns is no higher than the threshold voltage VL1 (Vsns≤VL1 is satisfied) (S105: Y), the following occur. That is, next, the control part 601 stores the DAC 601*a* setting value at that point of time as a setting value VDA3 (S106). This setting value (setting voltage) VDA3 corresponds to a tentative emitted light amount (emitted light setting value) in the light emitting part 212*a*, which is used in detecting the presence of the label sheet 9 by the medium detection sensor 212 at Timing T103 mentioned below. Also, the emitted light amount corresponding to this setting value VDA3 corresponds to a specific example of the "third emitted light amount" in this invention.

In this manner, the control part 601 sets the setting value VDA3 that corresponds to the above-mentioned tentative emitted light amount by performing light amount measurements using the light emitting part 212*a* and the light receiving part 212*b* in a state where the label sheet 9 is not facing with the medium detection sensor 212.

Figure 9B:
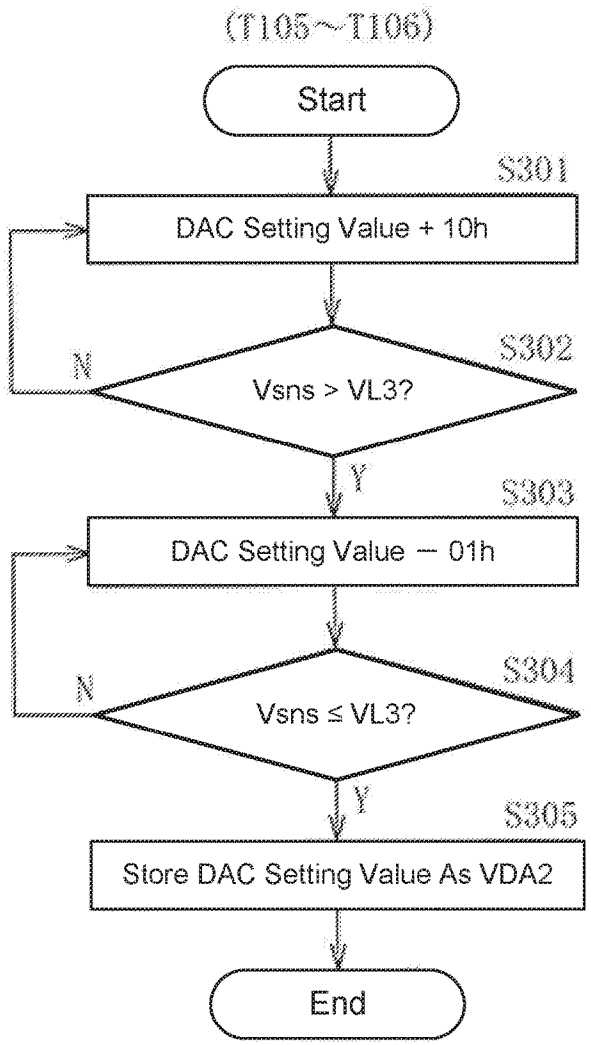
FIGS. 9A and 9B are flow charts showing operation examples during the periods following FIG. 7.
Figure 9A:
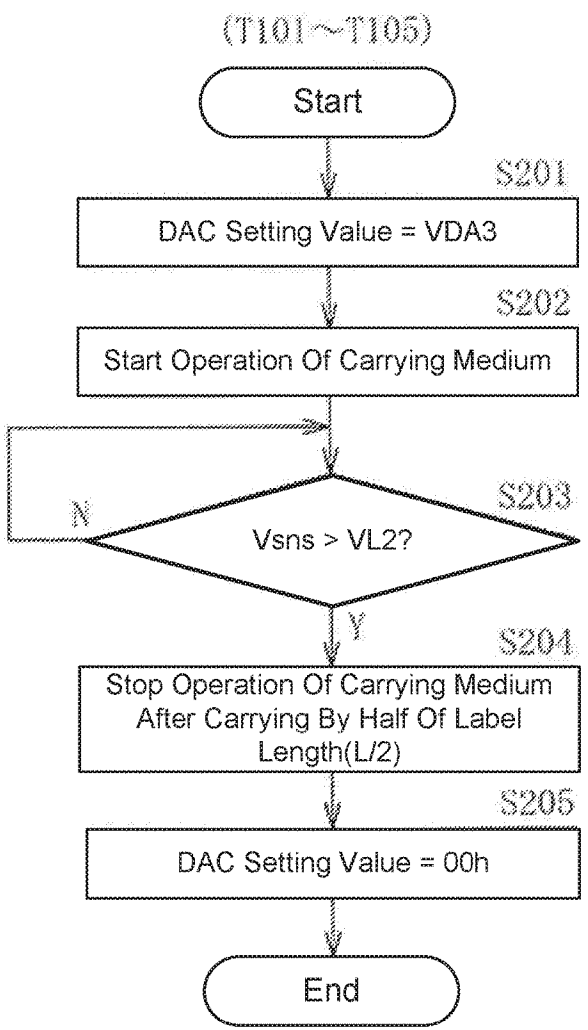
Figure 10:
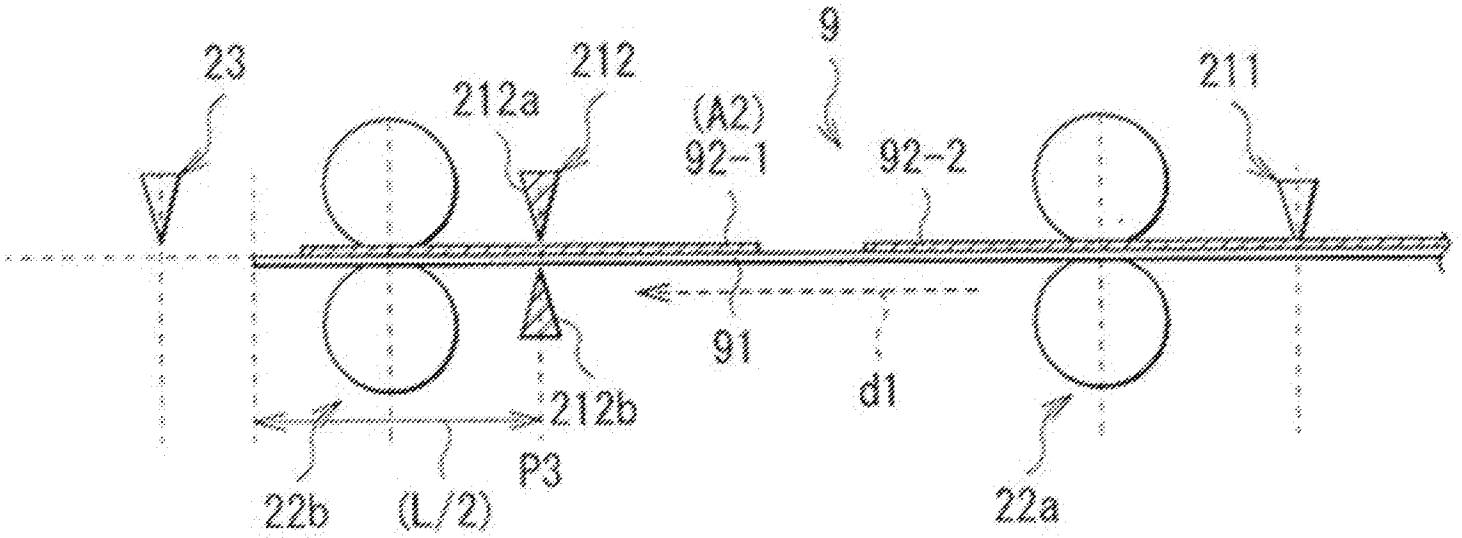
FIG. 10 is a schematic diagram showing an example state of the medium carrying device in the operation example shown in FIG. 9.

(Timings T101-T106: FIGS. 9A, 9B, and 10)

Next, during the period of Timings T101-T106 in FIG. 6, the control part 601 performs controls in a manner shown in FIGS. 9A, 9B, and 10 for example.

That is, first, the control part 601 sets the DAC 601*a* setting value to the above-mentioned setting value VDA3 (S201 in FIG. 9A). Next, the control part 601 starts an operation of carrying the label sheet 9 along the carrying direction d1 (S202, Timing T102).

Then, the control part 601 judges whether the sensor output voltage Vsns has become no higher than a specified threshold voltage VL2 (for example, VL2=2.0 V) (whether Vsns≤VL2 is satisfied) accompanying such an operation of carrying the label sheet 9 (S203). In other words, judged is whether the leading edge of the label sheet 9 has reached a position facing with the medium detection sensor 212 (whether the label sheet 9 has been detected by the medium detection sensor 212). Here, if it is judged that the sensor output voltage Vsns is higher than the threshold voltage VL2 (Vsns≤VL2 is not satisfied) (S203: N), the judgment in S203 is repeated.

On the other hand, if it is judged that the sensor output voltage Vsns is no higher than the threshold voltage VL2 (Vsns≤VL2 is satisfied) (S203: Y, Timing T103), it indicates that the leading edge of the label sheet 9 has reached the position facing with the medium detection sensor 212 (the label sheet 9 has been detected by the medium detection sensor 212). In this case, next, the control part 601 stops the operation of carrying the label sheet 9 at a position where the carrying distance reaches a half of the above-mentioned label length L (L/2) as shown in FIGS. 6 and 10 for example (S204, Timing T105). Thereby, the medium detection sensor 212 comes to face with a position on the first label 92-1 (label region A2) on the label sheet 9 (position in the vicinity of the central region of the label 92-1). Here, the carrying distance (L/2) that is the carrying distance at this time (distance from the position of the detected leading edge of the label sheet 9 to a position P3 that is the carriage stop position) is set based on the label length L. This position P3 corresponds to a specific example of the "third position" in this invention.

Note that the carrying distance at this time should desirably be set by further considering the above-mentioned leading edge length x. That is, referring to FIG. 2, the carrying distance at this time should desirably be set to {(L/2)+x}. If set in that manner, it becomes possible to carry the vicinity of the central region of the label 92-1 to the position of the medium detection sensor 212 with higher accuracy. As a result, achieved is further improvement of the detection accuracy of the label sheet 9 mentioned below.

After such S204, next, the control part 601 sets the DAC 601*a* setting value to 00h to put the light emitting element LD into the extinguished state (S205). Subsequently, the control part 601 increases the DAC 601*a* setting value by +10h to put the light emitting element LD into the emitting state (increase the emitted light amount) (S301 in FIG. 9B).

Subsequently, the control part 601 judges whether the sensor output voltage Vsns corresponding to the received light amount obtained by the light receiving element PD based on such light emission of the light emitting element LD has become higher than a specified threshold voltage VL3 (for example, VL3=1.5 V) (whether Vsns>VL3 is satisfied) (S302). Here, if it is judged that the sensor output voltage Vsns is not higher than the threshold voltage VL3 (Vsns>VL3 is not satisfied) (S302: N), the system transitions to S301 again to increase the emitted light amount.

The threshold voltage VL3 is determined to be a half of the maximum value of the light receiving amount. The maximum value is the third light amount and is detected where no medium is present between the light emitting element and the light receiving element, see T100 to T103 in FIG. 6, or T200 to T203 in FIG. 16. The threshold voltage VL3 varies 10% more or less with respect to the maximum value. When the maximum value is 3.1V, the threshold voltage VL3 is ranged between 1.2V to 1.3V.

On the other hand, if it is judged that the sensor output voltage Vsns is higher than the threshold voltage VL3 (Vsns>VL3 is satisfied) (S302: Y), the following occur. That is, next, the control part 601 decreases the DAC 601*a* setting value by −01h to decrease the emitted light amount (S303). Then, the control part 601 judges whether the sensor output voltage Vsns at that time has become no higher than the above-mentioned threshold voltage VL3 (whether Vsns≤VL3 is satisfied) (S304). Here, if it is judged that the sensor output voltage Vsns is higher than the threshold voltage VL3 (Vsns≤VL3 is not satisfied) (S304: N), the system transitions to S303 again to decrease the emitted light amount.

On the other hand, if it is judged that the sensor output voltage Vsns is no higher than the threshold voltage VL3 (Vsns≤VL3 is satisfied) (S304: Y), the following occur. That is, next, the control part 601 stores the DAC 601*a* setting value at that point of time as a setting value VDA2 (S305). This setting value (setting voltage) VDA2 corresponds to the tentative emitted light amount (emitted light setting value) in the light emitting part 212*a* used in detecting the trailing edge (trailing edge position) of the label 92-1 (label region A2) by the medium detection sensor 212 in Timing T107 mentioned below. Also, this emitted light amount corresponding to the setting value VDA2 corresponds to a specific example of the "second emitted light amount" in this invention.

In this manner, the control part 601 sets the setting value VDA2 that corresponds to the above-mentioned tentative emitted light amount by performing light amount measurements using the light emitting part 212*a* and the light receiving part 212*b* in the position P3 that is a position where the label 92-1 (label region A2) is facing with the medium detection sensor 212.

Figure 11B:
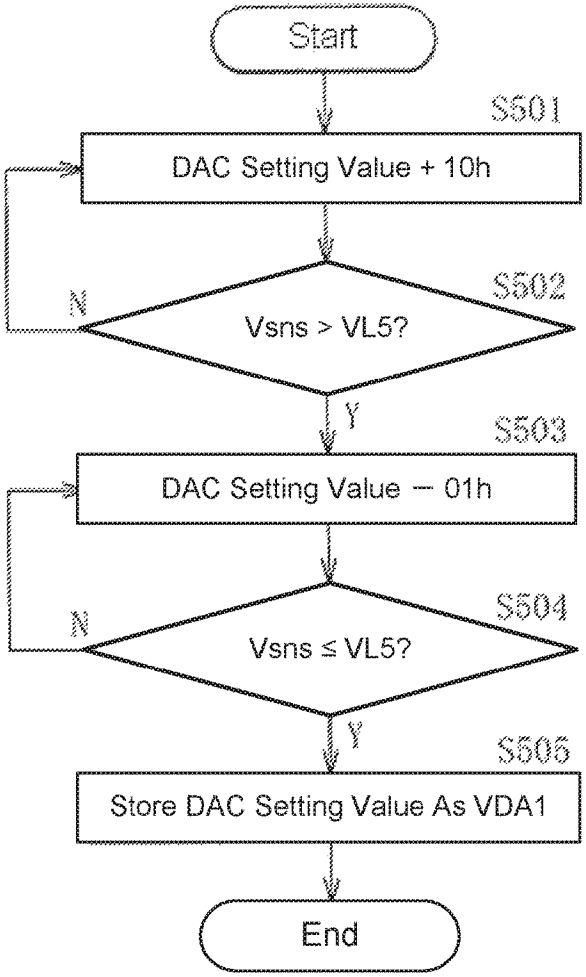
FIGS. 11A and 11B are flow charts showing operation examples during the periods following FIGS. 9A and 9B.
Figure 11A:
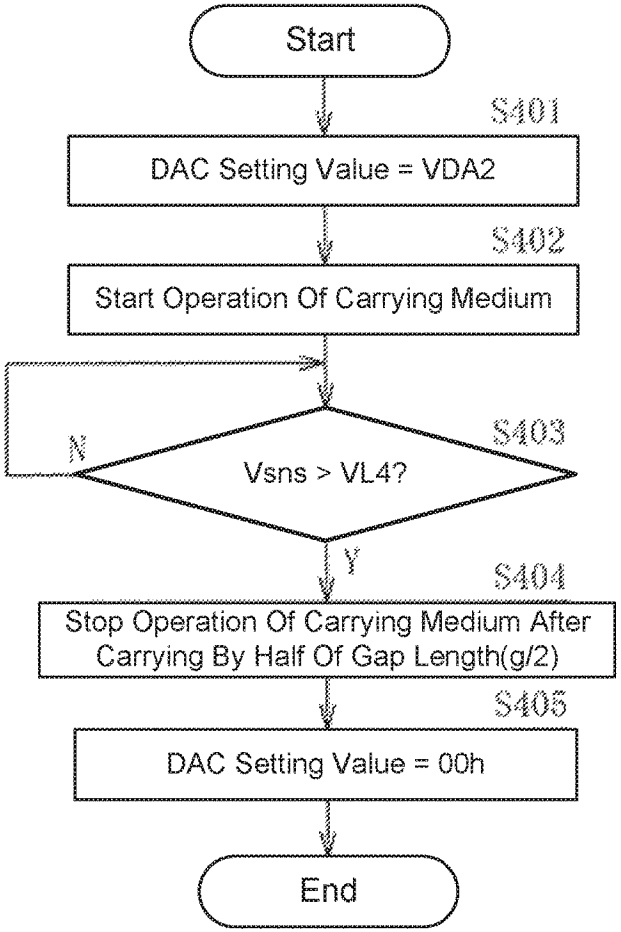
Figure 12:
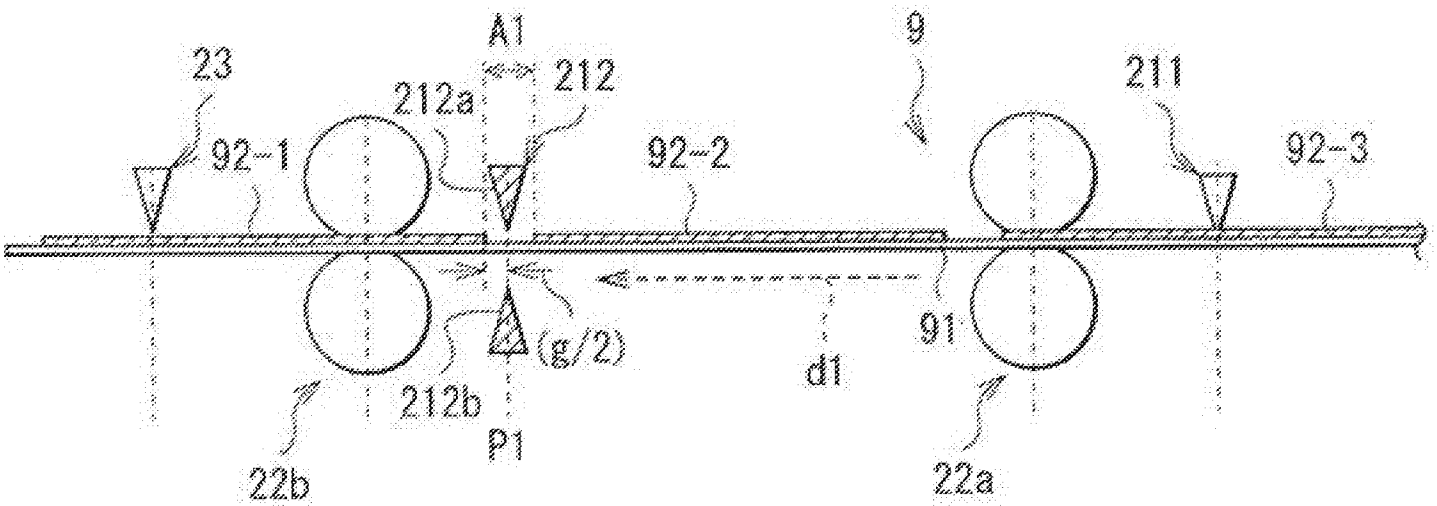
FIG. 12 is a schematic diagram showing an example state of the medium carrying device in the operation example shown in FIGS. 11A and 11B.

(Timings T106-T109: FIGS. 11A, 11B, and 12)

Subsequently, during the period of Timings T106-T109 in FIG. 6, the control part 601 performs controls in such a manner as shown in FIGS. 11A, 11B, and 12 for example.

That is, first, the control part 601 sets the DAC 601*a* setting value to the above-mentioned setting value VDA2 (S401 in FIG. 11A). Next, the control part 601 starts an operation of carrying the label sheet 9 along the carrying direction d1 (S402, Timing T106).

Then, the control part 601 judges whether the sensor output voltage Vsns has become higher than a threshold voltage VL4 (for example, VL4=1.8 V) (whether Vsns>VL4 is satisfied) accompanying such an operation of carrying the label sheet 9 (S403). In other words, it is judged whether the trailing edge of the label 92-1 (label region A2) has reached the position facing with the medium detection sensor 212 (whether the trailing edge of the label 92-1 has been detected by the medium detection sensor 212). Here, if it is judged that the sensor output voltage Vsns is no higher than the threshold voltage VL4 (Vsns>VL4 is not satisfied) (S403: N), the judgment in S403 is repeated.

The threshold value VL4 is determined between the threshold value VL3 and the threshold value VL5. The above emitted light amount is determined by thresholds VL3, VL4 and VL5. These thresholds satisfies the following:

$$VL5>VL4>VL3.$$

On the other hand, if it is judged that the sensor output voltage Vsns is higher than the threshold voltage VL4 (Vsns>VL4 is satisfied) (S403: Y, Timing T107), it indicates that the trailing edge of the label 92-1 has reached the position facing with the medium detection sensor 212 (the trailing edge of the label 92-1 has been detected by the medium detection sensor 212). In this case, next, the control part 601 stops the operation of carrying the label sheet 9 at a position where the carrying distance reaches a half of the above-mentioned gap length g (g/2) as shown in FIGS. 6 and 12 for example (S404, Timing T108). Thereby, the medium detection sensor 212 comes to face with a position on the base sheet 91 (base sheet region A1) between the label 92-1 and the label 92-2 (a position in the vicinity of the central region of the base sheet 91). Here, the carrying distance (g/2) that is the carrying distance at this time (distance from the position of the detected trailing edge of the label 92-1 to a position P1 that is the carriage stop position) is set based on the gap length g. This position P1 corresponds to a specific example of the "first position" in this invention.

After such S404, next, the control part 601 sets the DAC 601*a* setting value to 00h to put the light emitting element LD into the extinguished state (S405). Subsequently, the control part 601 increases the DAC 601*a* setting value by +10h to put the light emitting element LD into the emitting state (increase the emitted light amount) (S501 in FIG. 11B).

Next, the control part 601 judges whether the sensor output voltage Vsns corresponding to the received light amount obtained by the light receiving element PD based on such light emission of the light emitting element LD has become higher than a specified threshold voltage VL5 (for example, VL5=2.0 V) (whether Vsns>VL5 is satisfied) (S502). Here, if it is judged that the sensor output voltage Vsns is not higher than the threshold voltage VL5 (Vsns>VL5 is not satisfied) (S502: N), the system transitions to S501 again to increase the emitted light amount.

The threshold voltage VL5 is determined to be more than a half of the maximum value of the light receiving amount and to be a value that saturates the light receiving element PD or less. In the embodiment, since the maximum value is around 3.1V, the lower limit of the threshold voltage VL5 is more than 1.5V. Also, considering a safety margin, 10%, the upper limit is 2.7 V (10% off). The threshold voltage VL5 may be defined as to be more than 50% and 90% or less of the maximum value of the light received amount that is determined where the medium is not facing with the detection part.

On the other hand, if it is judged that the sensor output voltage Vsns is higher than the threshold voltage VL5 (Vsns>VL5 is satisfied) (S502: Y), the following occur. That is, next, the control part 601 decreases the DAC 601*a* setting value by −01h to decrease the emitted light amount (S503). Then, the control part 601 judges whether the sensor output voltage Vsns at that time has become no higher than the above-mentioned threshold voltage VL5 (whether Vsns≤VL5 is satisfied) (S504). Here, if it is judged that the sensor output voltage Vsns is higher than the threshold voltage VL5 (Vsns≤VL5 is not satisfied) (S504: N), the system transitions to S503 again to decrease the emitted light amount.

On the other hand, if it is judged that the sensor output voltage Vsns is no higher than the threshold voltage VL5 (Vsns≤VL5 is satisfied) (S504: Y), the following occur. That is, next, the control part 601 stores the DAC 601*a* setting value at that point of time as a setting value VDA1 (S505).

This setting value (setting voltage) VDA1 corresponds to the emitted light amount (emitted light setting value) in the light emitting part 212*a* used in the normal printing afterwards (image formation to the label sheet 9). Also, the amount of light corresponding to this setting value VDA1 corresponds to a specific example of the "first emitted light amount" in this invention.

In this manner, the control part 601 sets the setting value VDA1 that corresponds to the emitted light amount during the print operation mentioned above by performing light amount measurements using the light emitting part 212*a* and the light receiving part 212*b* in the position P1 that is a position where the base sheet 91 (base sheet region A1) between the label 92-1 and the label 92-2 is facing with the medium detection sensor 212.

Figure 13:
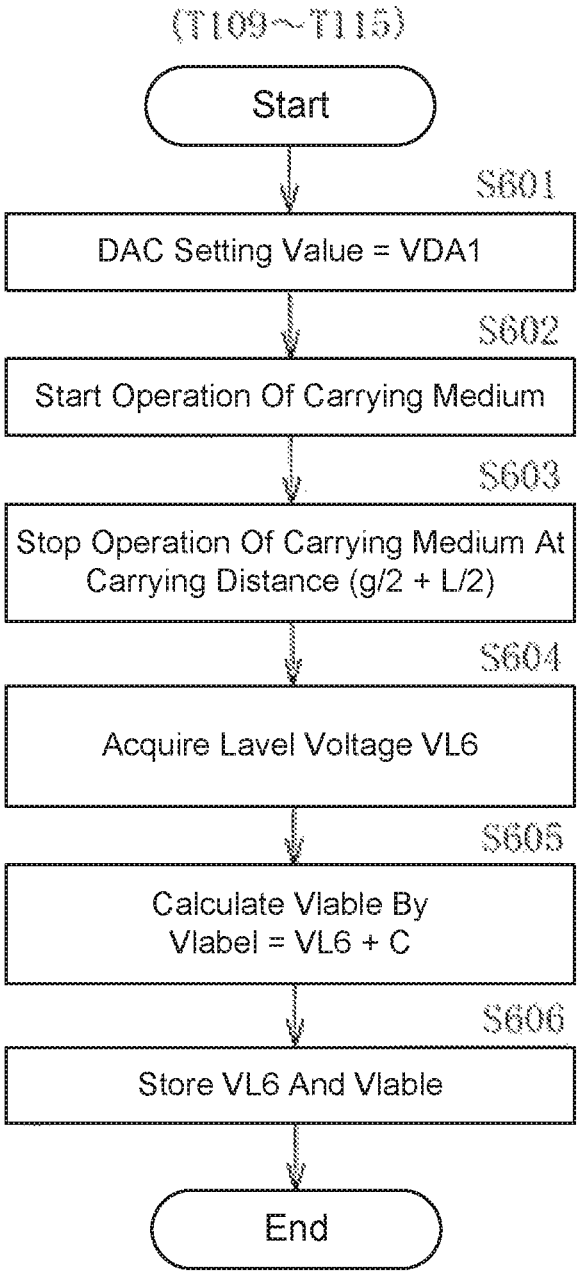
FIG. 13 is a flow chart showing an operation example during the period following FIGS. 11A and 11B.
Figure 14:
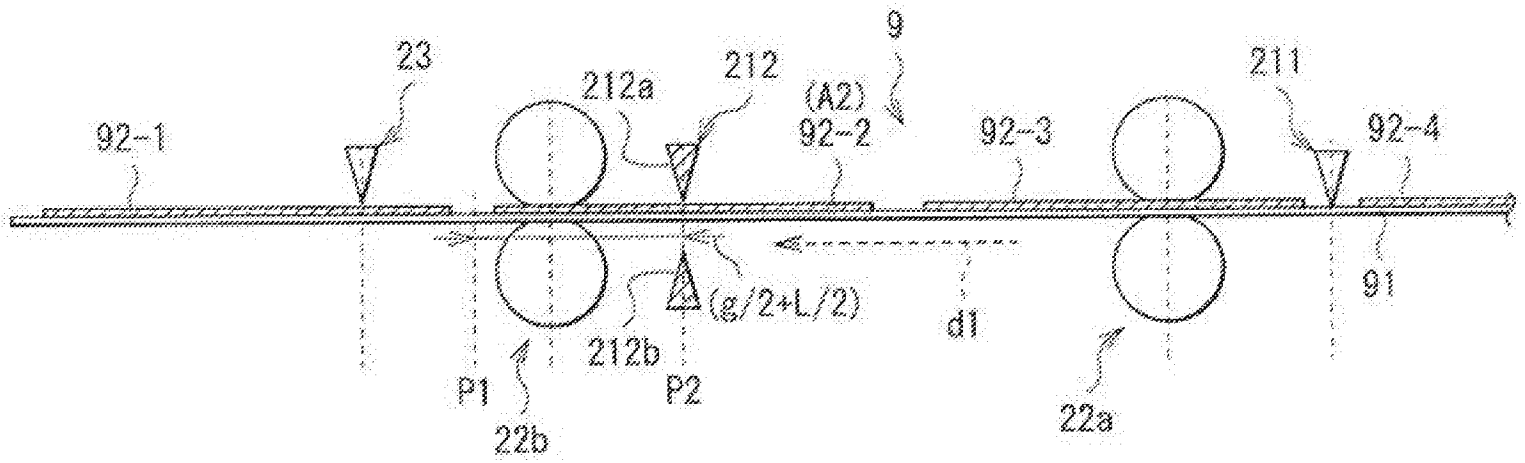
FIG. 14 is a schematic diagram showing an example state of the medium carrying device in the operation example shown in FIG. 13.

(Timings T109-T113: FIGS. 13 and 14)

Subsequently, during the period of Timings T109-T113 in FIG. 6, the control part 601 performs controls in such a manner as shown in FIGS. 13 and 14 for example.

That is, first, the control part 601 sets the DAC 601*a* setting value to the above-mentioned setting value VDA1 (S601 in FIG. 13). Next, the control part 601 starts an operation of carrying the label sheet 9 along the carrying direction d1 (S602, Timing T109).

Subsequently, as shown in FIGS. 6 and 14 for example, the control part 601 stops the operation of carrying the label sheet 9 at a position where the carrying distance reaches the added value (g/2+L/2) of a half of the gap length (g/2) and a half of the label length L (L/2) mentioned above (S603, Timing T111). Thereby, the medium detection sensor 212 comes to face with a position on the second label 92-2 (label region A2) on the label sheet 9 (a position in the vicinity of the central region of the label 92-2). Here, the carrying distance (g/2+L/2) that is the carrying distance at this time (distance from the above-mentioned position P1 to a position P2 that is the carriage stop position) is set based on both the gap length g and the label length L. This position P2 corresponds to a specific example of the "second position" in this invention.

Next, the control part 601 acquires, as a voltage VL6 (label voltage), the sensor output voltage Vsns corresponding to the received light amount obtained by the light receiving element PD based on light emission of the light emitting element LD at this time (S604, Timing T112). Subsequently, the control part 601 calculates a threshold voltage Vlabel used in detecting the boundary between the base sheet region A1 (base sheet 91) and the label region A2 (labels 92) on the label sheet 9 by the medium detection sensor 212 (S605). Then, the control part 601 stores the voltage VL6 and the threshold voltage Vlabel obtained in such a manner inside the control part 601 (S606). Note that C in the below calculation formula has a specified constant value (for example, C=0.3 V). Also, the amount of light corresponding to the above-mentioned threshold voltage Vlabel corresponds to a specific example of the "threshold amount of light" in this invention.

$$Vlabel = VL6 + C \quad \text{(Calculation formula)}$$

where the constant value is determined to be between the maximum value Vsns (or VL1) and the label voltage VL6. The constant value C may be small value corresponding to the value VL1. In the embodiment, the value C is 0.3V that is about 10% of the value VL1.

In this manner, the control part 601 sets the threshold voltage Vlabel corresponding to the above-mentioned threshold amount of light by performing light amount measurements using the light emitting part 212*a* and the light receiving part 212*b* in the position P2 that is a position where the label 92-2 (label region A2) is facing with the medium detection sensor 212.

(Timings T113-T117)

Next, the control part 601 resumes the operation of carrying the label sheet 9 along the carrying direction d1 (Timing T113 in FIG. 6). Then, the control part 601 performs the following control upon detecting that the sensor output voltage Vsns obtained in this carrying operation surpassed the above-mentioned threshold voltage Vlabel (Timing T114) and afterwards fell below this threshold voltage Vlabel again (Timing T115). That is, first, this timing corresponds to the fact that the medium detection sensor 212 is positioned above the third label 92-3 (label region A2) on the label sheet 9 as shown in FIG. 6 for example. Therefore, the control part 601 controls the cutter unit 23 so as to cut the label sheet 9 at a specified cut position which is between this label 92-3 and the label 92-2 (Timing T116) so that the label 92-2 is separated from the label 92-3. For doing so, the control part 601 carries the label sheet 9 and the label sheet 9 was cut just before the leading edge of the label 92-2 reaches the cutter unit 23. Then, the control part 601 stops the operation of carrying the label sheet 9 (Timing T117).

Besides, afterwards, a portion cut from the label sheet 9 in this manner (a portion from the leading edge of the label sheet 9 to the above-mentioned cut position in this example) is ejected from the image forming apparatus 1. At this time, an operation example in a series of sensitivity adjustments (a control operation example in the sensitivity adjustments of the medium detection sensor 212 by the control part 601) shown in FIGS. 6-14 is finished.

Then, during a print operation (image forming operation) after such sensitivity adjustments, after setting the emitted light amount of the light emitting part 212*a* to the setting value VDA1 obtained by the sensitivity adjustments, the control part 601 performs the following judgments depending on whether the sensor output voltage Vsns obtained by the medium detection sensor 212 is no lower than the threshold voltage Vlabel. That is, as shown in FIG. 6 for example, if the sensor output voltage Vsns is no lower than the threshold voltage Vlabel (Vsns≥Vlabel), the control part 601 judges that what is facing with the medium detection sensor 212 at that point of time is the base sheet region A1. On the other hand, if the sensor output voltage Vsns is lower than the threshold voltage Vlabel (Vsns<Vlabel), the control part 601 judges that what is facing with the medium detection sensor 212 at that point of time is the label region A2. Then, based on such information on the region judging result, image formation to the label sheet 9 is performed.

As in the above, in this embodiment, the control part 601 performs sensitivity adjustments of the medium detection sensor 212 in the following manner. That is, first, the control part 601 sets the setting value VDA1 corresponding to the emitted light amount during image formation by performing light amount measurements using the light emitting part 212*a* and the light receiving part 212*b* in the position P1 that is a position where the base sheet 91 (base sheet region A1) between the label 92-1 and the label 92-2 is facing with the medium detection sensor 212. Also, by performing such light amount measurements in the position P2 that is a position where the label 92-2 (label region A2) is facing with the medium detection sensor 212, the control part 601 sets the threshold voltage Vlabel used in detecting the boundary between the base sheet region A1 (base sheet 91) and the label region A2 (labels 92) by the medium detection sensor 212.

In this manner, while the emitted light amount during image formation (the setting value VDA1) is set in the base sheet region A1 (that is a narrow region where only the base sheet 91 is disposed), the threshold amount of light (threshold voltage Vlabel) for detecting the above-mentioned boundary position is set in the label region A2 (where both the base sheet 91 and one of the labels 92 are disposed). Thereby, in the sensitivity adjustments in this embodiment, unlike the sensitivity adjustments in the above-mentioned comparative example, for example, even if the transmittance of the base sheet 91 on the label sheet 9 is low, etc., it becomes easier to detect the boundary position between the base sheet 91 and one of the labels 92. As a result, in this embodiment, it becomes possible to detect a print medium (label sheet 9) of a variety of transmittances, enabling the detection of the label sheet 9 with high accuracy.

In the invention, these threshold voltages satisfies follows:

$$VL1>LV2$$

$$VL4>VL3$$

Threshold voltage VL5 is set to be a value in order not to cause the light receiving element saturated.

The setting values VDA2 and VDA3 are used to stop the medium on the sensor within the region A1.

2. Second Embodiment

Next, the second embodiment of this invention is explained. Explained in the above-mentioned first embodiment was an example method that the setting in the base sheet region A1 is performed after the setting in the first label region A2 (label 92-1) in the sensitivity adjustments of the medium detection sensor 212. As opposed to this, explained in the second embodiment explained below is an example method that the setting in the base sheet region A1 is directly performed after detecting the leading edge of the label sheet (label sheet 9A mentioned below) in the sensitivity adjustments of the medium detection sensor 212. Note that in the second embodiment, the same components as in the first embodiment are given the same codes, and their explanations are omitted if appropriate.

Configuration Example

First, because the configurations of the image forming apparatus and the medium carrying device in this embodiment are the same as those of the image forming apparatus 1 and the medium carrying device 2 explained in the first embodiment, the same codes are given in their explanations.

On the other hand, a label sheet as the print medium applied to the image forming apparatus 1 and the medium carrying device 2 in this embodiment have a different configuration from that of the label sheet 9 explained in the first embodiment.

(Label Sheet 9A)

Figures 15A, 15B:
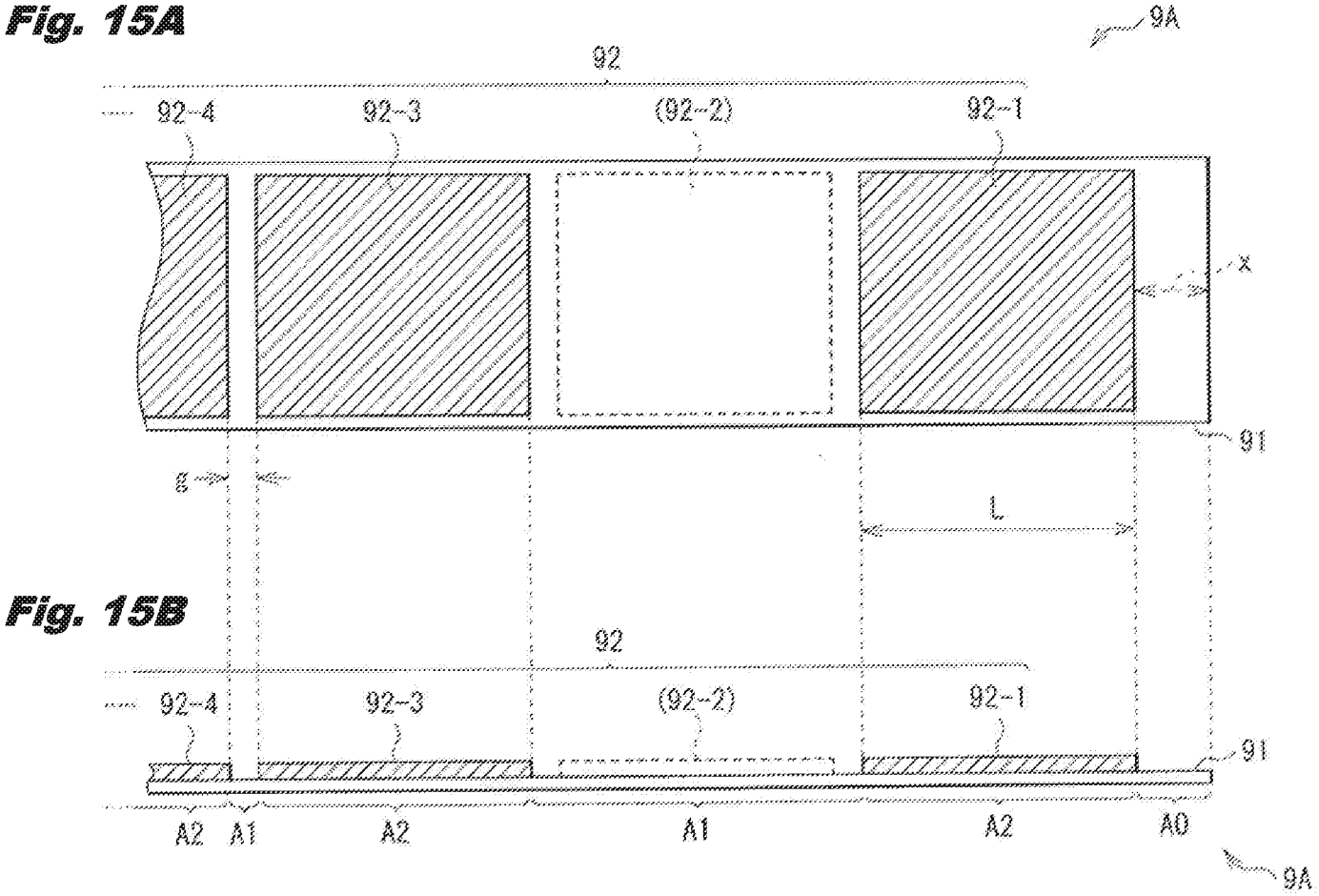
FIGS. 15A and 15B are schematic diagrams showing a configuration example of a label sheet of the second embodiment of this invention.

FIGS. 15A and 15B schematically show a configuration example of the label sheet (label sheet 9A) of this embodiment, where FIG. 15A shows an upper face configuration example, and FIG. 15B a side face (long side face of the label sheet 9A) configuration example.

This label sheet 9A is missing one of the labels 92 (label 92-2) that is the second from its leading edge among the labels 92 shown in FIGS. 2A and 2B. Specifically, the label 92-2 on the label sheet 9A is peeled off in advance by a user. Note that this label sheet 9A also corresponds to a specific example of the "print medium" in this invention.

[Operation and Effect]

In an image forming apparatus 5 of this embodiment, sensitivity adjustments of the medium detection sensor 212 are performed in the following manner. Note that because the basic operations (image forming operation etc.) in this embodiment are the same as those explained in the first embodiment, their explanations are omitted.

Figure 16:
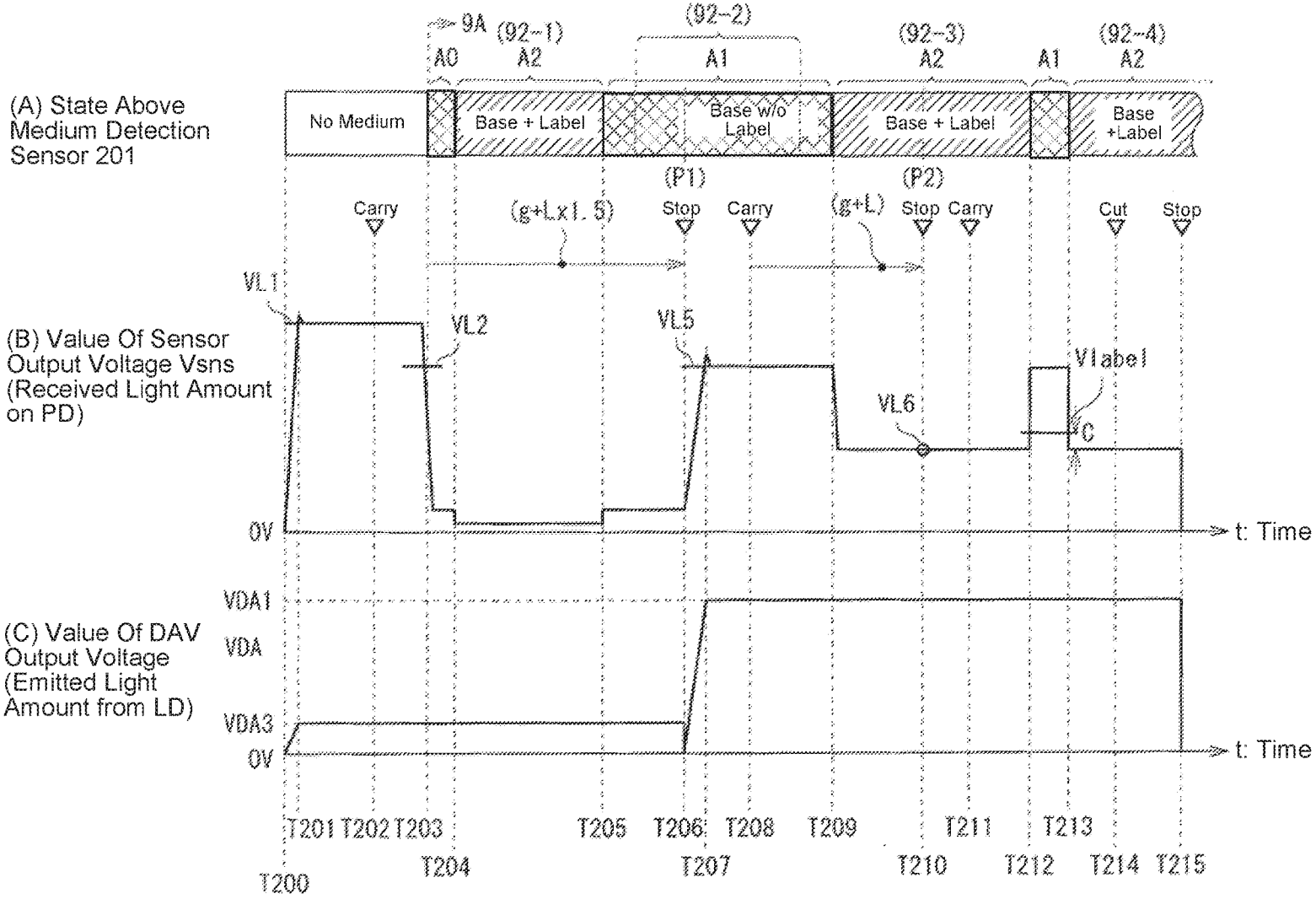
FIG. 16 is a timing chart showing an operation example of a medium carrying device of the second embodiment.

Here, FIG. 16 shows in a timing chart an operation example (operation example in the sensitivity adjustments) of the medium carrying device 2 of this embodiment. Specifically, (A) of FIG. 16 shows a state above the medium detection sensor 212 in this operation example. (B) of FIG. 16 shows the value of the sensor output voltage Vsns during this operation, which corresponds to the received light amount on the light receiving element PD. (C) of FIG. 16 shows the value of the above-mentioned DAC output voltage VDA during this operation, which corresponds to the emitted light amount of the light emitting element LD.

Figure 18:
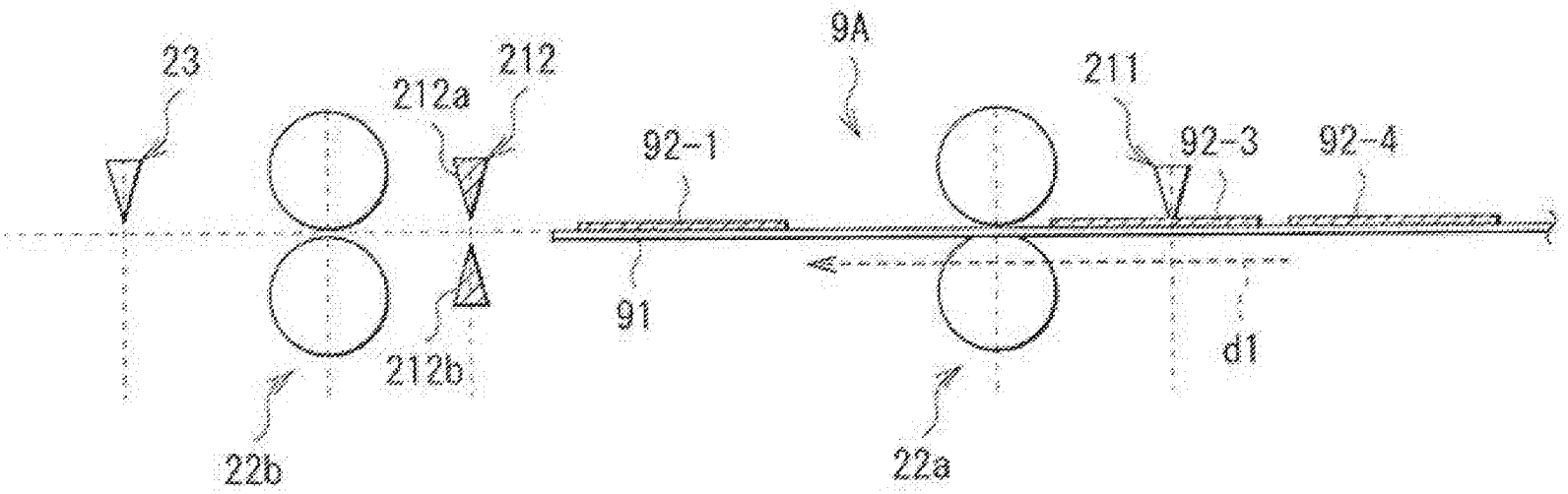
FIG. 18 is a schematic diagram showing an example state of the medium carrying device in the operation example shown in FIG. 17.
Figure 19B:
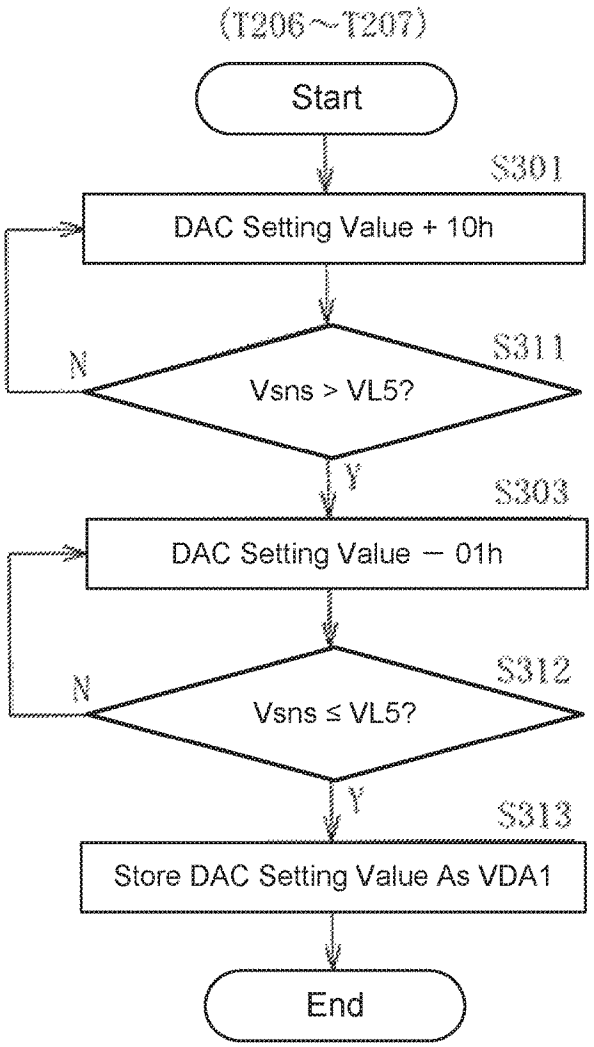
FIGS. 19A and 19B are flow charts showing operation examples during the periods following FIG. 17.
Figure 19A:
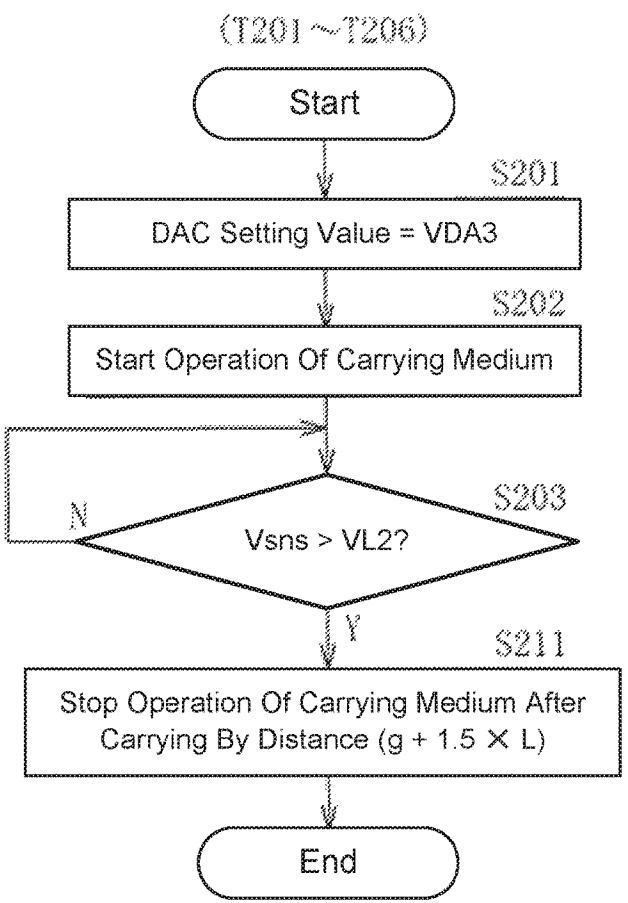
Figure 20:
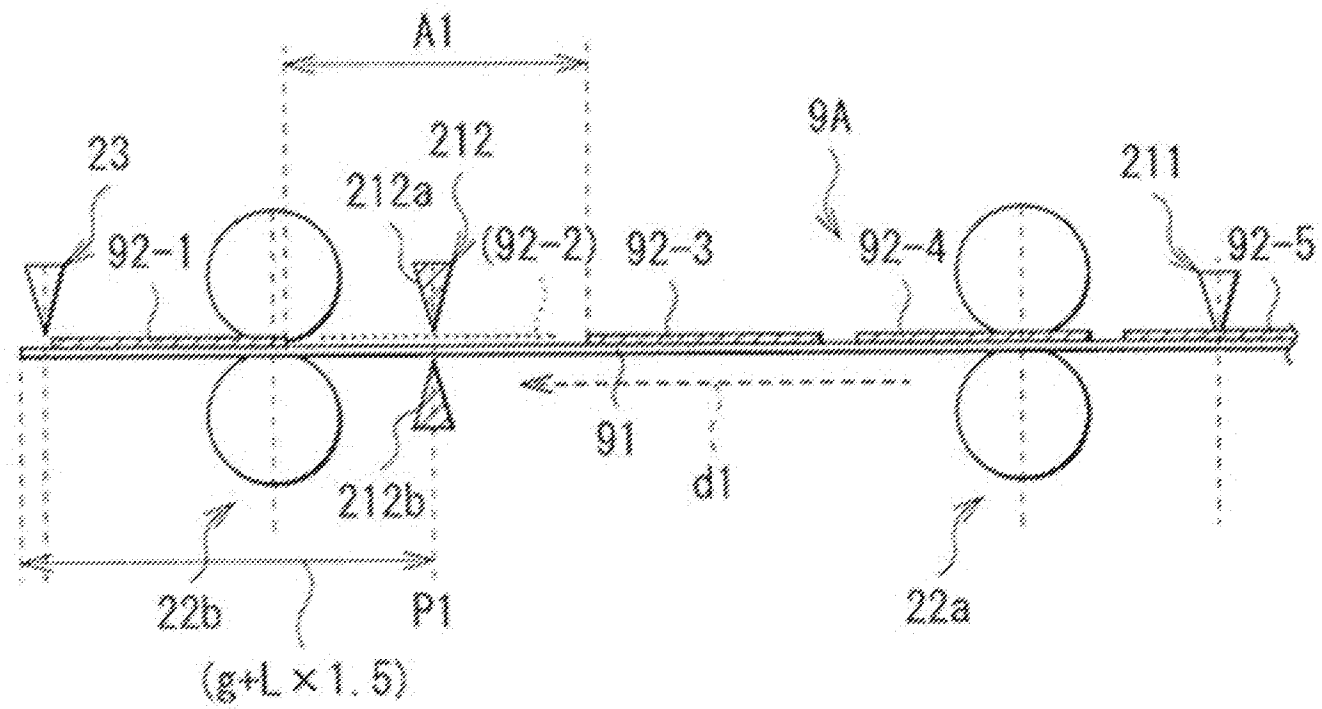
FIG. 20 is a schematic diagram showing an example state of the medium carrying device in the operation example shown in FIGS. 19A and 19B.
Figure 21:
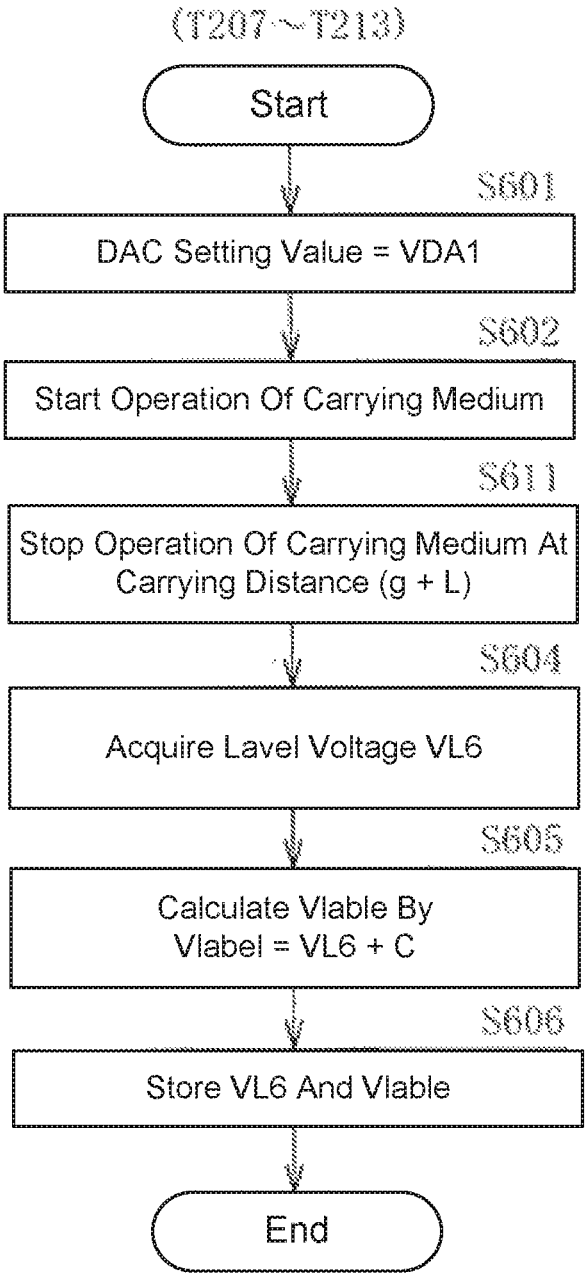
FIG. 21 is a flow chart showing an operation example during the period following FIGS. 19A and 19B.
Figure 22:
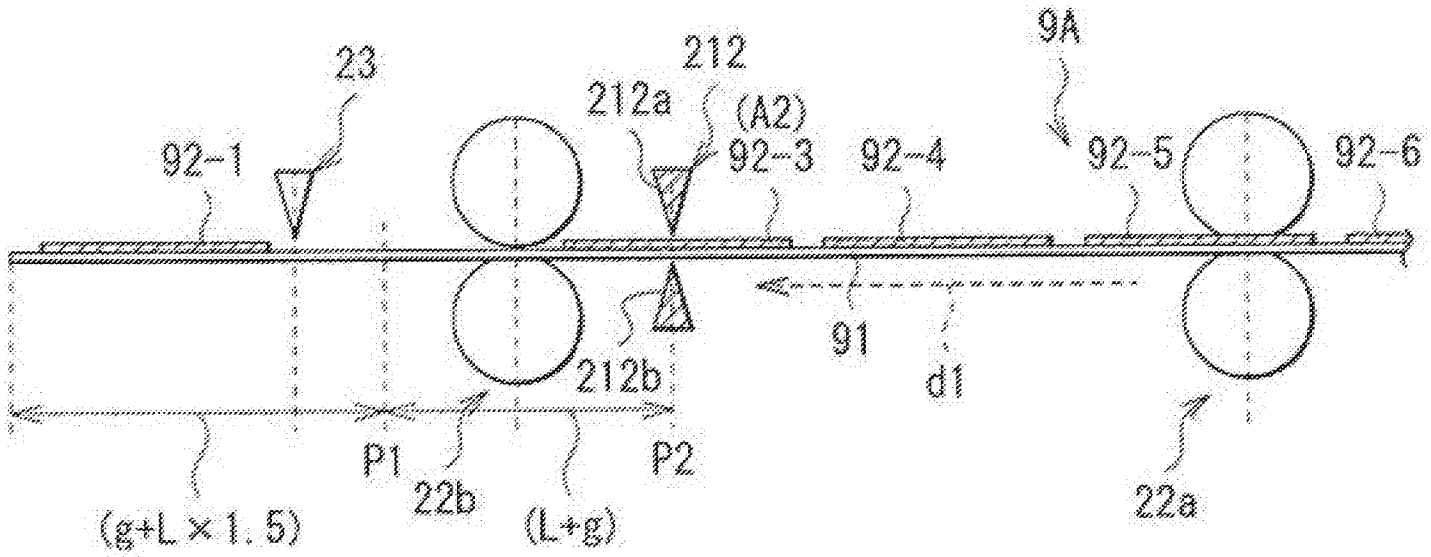
FIG. 22 is a schematic diagram showing an example state of the medium carrying device in the operation example shown in FIG. 21.

Also, FIGS. 17, 19A, 19B, and 21 each show the operation example during the sensitivity adjustments shown in FIG. 16 in flow charts in the order of time sequence. Then, FIGS. 18, 20, and 22 show schematically in side views the example states of the medium carrying device 2 during the operation shown in these FIGS. 17, 19A, 19B, and 21, respectively.

Figure 17:
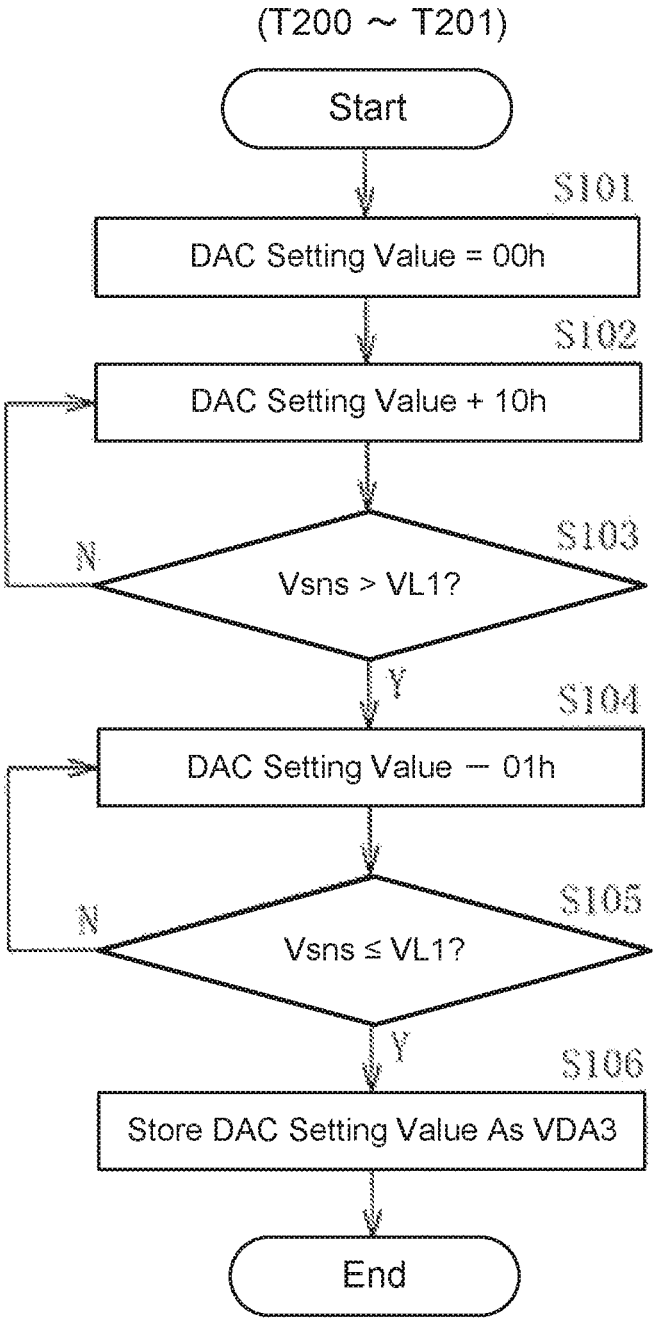
FIG. 17 is a flow chart showing an operation example during a partial period in the operation example shown in FIG. 16.

(Timings T200-T201: FIGS. 17 and 18)

In the sensitivity adjustments of this embodiment, first, during the period of Timings T200-T201, the control part 601 performs controls in a manner shown in FIGS. 17 and 18 for example.

That is, the control part 601 sets the setting value VDA3 corresponding to a tentative emitted light amount by performing light amount measurements using the light emitting part 212*a* and the light receiving part 212*b* in a state where the label sheet 9A is not facing with the medium detection sensor 212. This tentative emitted light amount corresponds to the tentative emitted light amount (emitted light setting value) in the light emitting part 212*a* used in detecting the presence of the label sheet 9A by the medium detection sensor 212 at Timing T203 mentioned below.

Note that because this operation example during the period of Timings T200-T201 (S101-S106 in FIG. 17) is basically the same as the operation example during the period of Timings T100-T101 (FIGS. 7 and 8), specific explanations are omitted.

(Timings T201-T207: FIGS. 19A, 19B, and 20)

Next, during the period of Timings T201-T206, the control part 601 performs controls in a manner shown in FIGS. 19A, 19B, and 20 for example.

That is, first, the control part 601 sets the DAC 601*a* setting value to the above-mentioned setting value VDA3 (S201 in FIG. 19A). Next, the control part 601 starts an operation of carrying the label sheet 9 along the carrying direction d1 (S202, Timing T202).

Then, the control part 601 judges whether the sensor output voltage Vsns has become no higher than the above-mentioned threshold voltage VL2 (for example, VL2=2.0 V) (whether Vsns≤VL2 is satisfied) accompanying such an operation of carrying the label sheet 9 (S203). In other words, it is judged whether the leading edge of the label sheet 9A has reached the position facing with the medium detection sensor 212 (whether the label sheet 9A has been detected by the medium detection sensor 212). Here, if it is judged that the sensor output voltage Vsns is higher than the threshold voltage VL2 (Vsns≤VL2 is not satisfied) (S203: N), the judgment in S203 is repeated.

On the other hand, if it is judged that the sensor output voltage Vsns is no higher than the threshold voltage VL2 (Vsns≤VL2 is satisfied) (S203: Y, Timing T203), it indicates that the leading edge of the label sheet 9A has reached the position facing with the medium detection sensor 212 (the label sheet 9A has been detected by the medium detection sensor 212). In this case, as shown in FIGS. 6 and 20 for example, next, the control part 601 stops the operation of carrying the label sheet 9A at a position where the carrying distance reaches the added value (g+1.5×L) of the above-mentioned gap length (g) and 1.5 times the label length L (1.5×L) (S211, Timing T206). Thereby, the medium detection sensor 212 comes to face with a position on the base sheet 91 (base sheet region A1) between the label 92-1 and the label 92-3 (a position in the vicinity of the central region of the base sheet 91). Note that this position corresponds to a position in the vicinity of the central region on the label 92-2 before it was peeled off as shown in FIGS. 16 and 20 for example. Here, the carrying distance (g+1.5×L) that is the carrying distance at this time (distance from the position of the detected leading edge of the label sheet 9A to a position P1 that is the carriage stop position) is set based on both the gap length g and the label length L.

Note that the carrying distance at this time should also desirably be set by further considering also the above-mentioned leading edge length x in the same manner as in the first embodiment. That is, referring to FIGS. 15A and 15B, the carrying distance at this time should desirably be set to {(g+1.5×L)+x}. If set in that manner, it becomes possible to carry more accurately the vicinity of the central region of the base sheet 91 between the label 92-1 and the label 92-3 (the vicinity of the central region on the label 92-2 before it was peeled off) to the position of the medium detection sensor 212. As a result, further improvement of the detection accuracy of the label sheet 9A mentioned below is achieved.

After such S204, next, the control part 601 increases the DAC 601*a* setting value by +10h to increase the emitted light amount of the light emitting element LD (S301 in FIG. 19B).

Next, the control part 601 judges whether the sensor output voltage Vsns corresponding to the received light amount obtained by the light receiving element PD based on such light emission of the light emitting element LD has become higher than the above-mentioned threshold voltage VL5 (for example, VL5=2.0 V) (whether Vsns>VL5 is satisfied) (S311). Here, if it is judged that the sensor output voltage Vsns is not higher than the threshold voltage VL5 (Vsns>VL5 is not satisfied) (S311: N), the system transitions to S301 again to increase the emitted light amount.

On the other hand, if it is judged that the sensor output voltage Vsns is higher than the threshold voltage VL5 (Vsns>VL5 is satisfied) (S311: Y, Timing T207), the following occur. That is, next, the control part 601 decreases the DAC 601*a* setting value by −01h to decrease the emitted light amount (S303). Then, the control part 601 judges whether the sensor output voltage Vsns at that time has become no higher than the above-mentioned threshold voltage VL5 (whether Vsns≤VL5 is satisfied) (S312). Here, if it is judged that the sensor output voltage Vsns is higher than the threshold voltage VL5 (Vsns≤VL5 is not satisfied) (S312: N), the system transitions to S303 again to decrease the emitted light amount.

On the other hand, if it is judged that the sensor output voltage Vsns is no higher than the threshold voltage VL5 (Vsns≤VL5 is satisfied) (S312: Y), the following occur. That is, next, the control part 601 stores the DAC 601*a* setting value at that point of time as a setting value VDA1 (S313). This setting value (setting voltage) VDA1 corresponds to the emitted light amount (emitted light setting value) in the light emitting part 212*a* used in the normal printing afterwards (image formation to the label sheet 9A).

In this manner, the control part 601 sets the setting value VDA1 that corresponds to the above-mentioned emitted light amount during the print operation by performing light amount measurements using the light emitting part 212*a* and the light receiving part 212*b* in the position P1 that is a position where the base sheet 91 (base sheet region A1) between the label 92-1 and the label 92-3 is facing with the medium detection sensor 212.

(Timings T207-T211: FIGS. 21 and 22)

Subsequently, during the period of Timings T207-T211 in FIG. 16, the control part 601 performs controls in a manner shown in FIGS. 21 and 22 for example.

That is, first, the control part 601 sets the DAC 601*a* setting value to the above-mentioned setting value VDA1 (S601 in FIG. 21). Next, the control part 601 starts an operation of carrying the label sheet 9A in the carrying direction d1 (S602, Timing T208).

Subsequently, as shown in FIGS. 16 and 22 for example, the control part 601 stops the operation of carrying the label sheet 9A at a position where the carrying distance reaches the added value (g+L) of the gap length (g) and the label length (L) mentioned above (S611, Timing T210). Thereby, the medium detection sensor 212 comes to face with a position on the third label 92-3 (label region A2) on the label sheet 9A (a position in the vicinity of the central region of the label 92-3). Here, the carrying distance (g+L) that is the carrying distance at this time (distance from the above-mentioned position P1 to a position P2 that is the carriage stop position) is set based on both the gap length g and the label length L.

Next, the control part 601 acquires as a voltage VL6 (label voltage) the sensor output voltage Vsns corresponding to the received light amount obtained by the light receiving element PD based on light emission by the light emitting element LD at this time (S604, Timing T210). Subsequently, using the above-mentioned calculation formula (Vlabel=VL6+C), the control part 601 calculates the threshold voltage Vlabel used in detecting the boundary (boundary position) between the base sheet region A1 (base sheet 91) and the label region A2 (labels 92) on the label sheet 9A by the medium detection sensor 212 (S605). Then, the control part 601 stores the voltage VL6 and the threshold voltage Vlabel obtained in this manner inside the control part 601 (S606).

In this manner, the control part 601 sets the threshold voltage Vlabel corresponding to the above-mentioned threshold amount of light by performing light amount measurements using the light emitting part 212*a* and the light receiving part 212*b* in the position P2 that is a position where the label 92-3 (label region A2) is facing with the medium detection sensor 212.

(Timings T211-T215)

Next, the control part 601 resumes the operation of carrying the label sheet 9A along the carrying direction d1 (Timing T211 in FIG. 16). Then, the control part 601 performs the following controls upon detecting that the sensor output voltage Vsns obtained in this carrying operation surpassed the above-mentioned threshold voltage Vlabel (Timing T212) and afterwards fell below this threshold voltage Vlabel again (Timing T213). That is, first, this timing corresponds to the fact that the medium detection sensor 212 is positioned above the fourth label 92-4 (label region A2) on the label sheet 9A as shown in FIG. 16 for example. Therefore, the control part 601 controls the cutter unit 23 so as to cut the label sheet 9A at a specified cut position on this label 92-4 (Timing T214). Then, the control part 601 stops the operation of carrying the label sheet 9A (Timing T215).

Besides, afterwards, a portion cut from the label sheet 9A in this manner (a portion from the leading edge of the label sheet 9A to the above-mentioned cut position in this example) is ejected from the image forming apparatus 1. At this time, an operation example in a series of sensitivity adjustments (a control operation example in the sensitivity adjustments of the medium detection sensor 212 by the control part 601) shown in FIGS. 16-22 is finished.

Then, during a print operation (image forming operation) after such sensitivity adjustments, after setting the emitted light amount of the light emitting part 212*a* to the setting value VDA1 obtained by the sensitivity adjustments, the control part 601 performs the following judgments depending on whether the sensor output voltage Vsns obtained by the medium detection sensor 212 is higher than the threshold voltage Vlabel. That is, as shown in FIG. 16 for example, if the sensor output voltage Vsns is no lower than the threshold voltage Vlabel (Vsns≥Vlabel), the control part 601 judges that what is facing with the medium detection sensor 212 at that point of time is the base sheet region A1. On the other hand, if the sensor output voltage Vsns is lower than the threshold voltage Vlabel (Vsns≤Vlabel), the control part 601 judges that what is facing with the medium detection sensor 212 at that point of time is the label region A2. Then, based on such information on the region judging result, image formation to the label sheet 9A is performed.

As in the above, in this embodiment also, in a similar manner as in the first embodiment, the control part 601 performs sensitivity adjustments of the medium detection sensor 212 in the following manner. That is, first, the control part 601 sets the setting value VDA1 corresponding to the emitted light amount during image formation by performing light amount measurements using the light emitting part 212*a* and the light receiving part 212*b* in the position P1 that is a position where the base sheet 91 (base sheet region A1) between the label 92-1 and the label 92-3 is facing with the medium detection sensor 212. Also, by performing such light amount measurements in the position P2 that is a position where the label 92-3 (label region A2) is facing with the medium detection sensor 212, the control part 601 sets the threshold voltage Vlabel used in detecting the boundary position between the base sheet region A1 (base sheet 91) and the label region A2 (labels 92) by the medium detection sensor 212.

In this manner, in this embodiment also, while the emitted light amount during image formation (setting value VDA1) is set in the base sheet region A1 (that is a narrow region where only the base sheet 91 is disposed), the threshold amount of light (threshold voltage Vlabel) for detecting the above-mentioned boundary position is set in the label region A2 (where both the base sheet 91 and one of the labels 92 are disposed). Thereby, in the sensitivity adjustments in this embodiment also, unlike the sensitivity adjustments in the above-mentioned comparative example, for example, even if the transmittance of the base sheet 91 on the label sheet 9A is low, etc., it becomes easier to detect the boundary position between the base sheet 91 and one of the labels 92. As a result, in this embodiment also, it becomes possible to detect a print medium (label sheet 9A) of a variety of transmittances, enabling the detection of the label sheet 9A with high accuracy.

Also, especially in this embodiment, because the setting on the base sheet region A1 is directly performed without performing the trailing edge detection of the first label region A2 (label 92-1) after the leading edge of the label sheet 9A is detected, the following efficacy can also be obtained. That is, for example, compared with the first embodiment that performs the setting in the base sheet region A1 after performing the trailing edge detection of the label region A1 after setting on the first label region A2, the boundary position on the print medium can be more certainly detected, further improving the detection accuracy of the print medium.

Specifically, in the method of the first embodiment, during the migration from the position P3 to the position P1, for example, if the transmittance difference between the base sheet 91 and the labels 92 is especially low (for example, if the transmittance of the base sheet 91 is especially low), etc., it could become difficult to detect the trailing edge of the first label region A2 (label 92-1) in cases. As opposed to this, in the method of this embodiment, as mentioned above, because the setting in the base sheet region A1 is directly performed without performing the trailing edge detection of the first label region A2, even in such a case, the possibility of having the setting accuracy decline in the sensitivity adjustments can be avoided.

3. Modifications

Although this invention was explained referring to several embodiments above, this invention is not limited by these embodiments, but various kinds of modifications are possible.

For example, although in the above-mentioned embodiments, explanations were given referring specifically to the configurations (shapes, dispositions, numbers of pieces, etc.) of the individual members in an image forming apparatus, these configurations of the individual members are not limited to those explained in the above-mentioned embodiments but may take other shapes, dispositions, numbers of pieces, etc. Also, values of the various kinds of parameters and their magnitude relations explained in the above-mentioned embodiments are not limited to those explained in the above-mentioned embodiments but may be controlled to take other values and magnitude relations.

Also, although in the above-mentioned embodiments, example methods of sensitivity adjustments of the medium detection sensor 212 were specifically explained, this method of sensitivity adjustments is not limited to those explained in the above-mentioned embodiments, but another method may be utilized.

Further, although in the above-mentioned embodiments, explanations were given by specifically referring to configuration examples of the print medium (label sheet), the configuration example of the label sheet is not limited to those explained in the above-mentioned embodiments, but another configuration may be adopted.

In addition, although in the above-mentioned embodiments, explanations were given on cases where the gap length g and the label length L (and the leading edge length x) were all values input by the user using the operation panel 602, this invention is not limited to this. That is, for example, these values may be the values determined by the device specifications (predetermined values; for example, the gap length g=3.0 mm, the label length L=25.4 mm, etc.).

Also, although in the above-mentioned embodiments, explanations were given referring to a so-called intermediate transfer image forming apparatus as an example, this invention is not limited to this. That is, this invention can be applied to a so-called direct transfer image forming apparatus that transfers toner images directly to a print medium without going through an intermediate transfer belt unit.

Further, although in the above-mentioned embodiments, explanations were given referring to cases where multiple (five of image drum units 31W, 31M, 31Y, 31C, and 31K) image drum units (image forming units) were provided as examples, this invention is not limited to them. That is, the number of image forming units that form toner images, the combination of toner colors used for them, the order of forming individual color toner images (the order of disposing multiple image forming units), and the like can be arbitrarily set according to the application and purpose. Also, in some cases, the number of image forming units can be made just one to make the toner image a monochrome (single color) image. That is, the image forming apparatus can be made function as a monochrome printer.

In addition, although in the above-mentioned embodiments, explanations were given referring to the label sheet as an example of the "print medium" in this invention, print medium is not limited to this, but another medium may be used as far as it comprises the "first medium" and the "second media" in this invention.

Also, although in the above-mentioned embodiments, explanations were given referring to an image forming apparatus that functions as an electrophotographic printer (label printer) as a specific example of the "image forming apparatus" in this invention, this invention is not limited to this. That is, the "medium carrying device" (the method of sensitivity adjustments of the detection part explained in the above-mentioned embodiments) in this invention is not limited to such an image forming apparatus (electrophotographic printer) but can be applied to thermal printers, inkjet printers, etc. for example.

What is claimed is:

1. A medium carrying device, comprising:

a carrying part that carries a print medium comprising a first medium and multiple second media disposed with a specified interval each other on the first medium along a carrying path, the first medium being a continuous sheet, a detection part that includes a light emitting part and a light receiving part arranged sandwiching the carrying path, and that detects the print medium carried on the carrying path according to a light amount of a light that is received by the light receiving part, the light being emitted from the light emitting part and coming through the carrying path, and a control part that controls operations of the carrying part and the detection part, wherein the print medium comprises a first region positioned between the multiple second media and a second region that is a region where the second media are disposed on the first medium, the detection part performs light amount measurements, the light amount measurements being processes using the light emitting part and the light receiving part in which a light emitting amount by the light emitting part is determined so that the light receiving part receives a predetermined light receiving amount from the light emitting part, the control part using a second emitted light amount (VDA2) of the emitted light of the light emitting part, determines that a trailing edge position of the second region has reached based on a first threshold light amount (VL4) by performing the light amount measurement in a state where the print medium is carried to a third position that is a position where the second region is facing with the detection part and is located in the front side of a first position where the first region of the print medium is facing with the detection part, based on a second threshold light amount (VL5) determined based on the first threshold light amount, sets a first emitted light amount (VDA1) of the emitted light of the light emitting part, the first emitted light amount being less than the second emitted light amount, the second threshold light amount being used in image formation to the print medium by performing another light amount measurement in a state where the print medium is carried to the first position so as to set the first emitted light amount as a predetermined emitted light amount of the light emitted by the light emitting part for carrying the print medium and received by the light receiving part, and using the first emitted light amount, sets a third threshold light amount (Vlabel) that is used in detecting a boundary position between the first region and the second region by the detection part based on the receiving light amount in a state where the print medium is carried from the first position to a second position that is a position where the second region is facing with the detection part.

2. The medium carrying device according to claim 1, wherein a carrying distance of the print medium by the carrying part from the trailing edge position of the second region detected by the detection part to the first position is set based on a length of the first region along a carrying direction.

3. The medium carrying device according to claim 1, wherein a carrying distance of the print medium by the carrying part from the first position to the second position is set based on both length of the first region along the carrying direction and length of the second region along the carrying direction.

4. The medium carrying device according to claim 1, wherein before setting the first threshold light amount, the control part sets a third emitted light amount that is the emitted light amount of the light emitting part used in detecting the presence of the print medium by the detection part through performing another light amount measurement in a state where the print medium is not facing with the detection part.

5. The medium carrying device according to claim 4, wherein a carrying distance of the print medium by the carrying part from the leading edge position of the print medium detected by the detection part to the third position is set based on length of the second region along the carrying direction.

6. The medium carrying device according to claim 5, wherein a carrying distance of the print medium from the leading position of the print medium to the third position is set by further considering length from the leading edge position of the print medium to the first of the second media.

7. The medium carrying device according to claim 1, wherein the second of the second media from the leading edge of the print medium is missing, and before setting the first emitted light amount, the control part sets a third emitted light amount that is the emitted light amount of the light emitting part used in detecting the presence of the print medium by the detection part through performing the light amount measurements in a state where the print medium is not facing with the detection part.

8. The medium carrying device according to claim 7, wherein a carrying distance of the print medium by the carrying part from the leading edge position of the print medium detected by the detection part to the first position is set based on both length of the first region along the carrying direction and length of the second region along the carrying direction.

9. The medium carrying device according to claim 8, wherein a carrying distance of the print medium from the leading position of the print medium to the first position is set by further considering length from the leading position of the print medium to the first of the second media.

10. The medium carrying device according to claim 7, wherein a carrying distance of the print medium by the carrying part from the first position to the second position is set based on both length of the first region along the carrying direction and length of the second region along the carrying direction.

11. An image forming apparatus, comprising:

a medium carrying device that carries a print medium comprising a first medium and multiple second media disposed with a specified interval each other on the first medium along a carrying path, the first medium being a continuous sheet, an image forming part that performs image formation to the print medium carried up by the medium carrying device, wherein the medium carrying device further comprises a detection part that includes a light emitting part and a light receiving part arranged sandwiching the carrying path, and that detects the print medium carried on the carrying path according to a light amount of a light that is received by the light receiving part, the light being emitted from the light emitting part and coming through the carrying path, and a control part that controls operations of the carrying part and the detection part, the print medium comprises a first region positioned between the multiple second media and a second region that is a region where the second media are disposed on the first medium, the detection part performs light amount measurements, the light amount measurements being processes using the light emitting part and the light receiving part in which a light emitting amount by the light emitting part is determined so that the light receiving part receives a predetermined light receiving amount from the light emitting part, the control part using a second emitted light amount (VDA2) of the emitted light of the light emitting part, determines that a trailing edge position of the second region has reached based on a first threshold light amount (VL4) by performing the light amount measurement in a state where the print medium is carried to a third position that is a position where the second region is facing with the detection part and is located in the front side of a first position where the first region of the print medium is facing with the detection part, based on a second threshold light amount (VL5) determined based on the first threshold light amount, sets a first emitted light amount (VDA1) of the emitted light of the light emitting part, the first emitted light amount being less than the second emitted light amount, the second threshold light amount being used in image formation to the print medium by performing another light amount measurement in a state where the print medium is carried to the first position so as to set the first emitted light amount as a predetermined emitted light amount of the light emitted by the light emitting part for carrying the print medium and received by the light receiving part, and using the first emitted light amount, sets a third threshold light amount (Vlabel) that is used in detecting a boundary position between the first region and the second region by the detection part based on the receiving light amount in a state where the print medium is carried from the first position to a second position that is a position where the second region is facing with the detection part.

* * * * *